US010507500B1

(12) United States Patent
Hunter et al.

(10) Patent No.: US 10,507,500 B1
(45) Date of Patent: Dec. 17, 2019

(54) BIOSAFETY CABINET WITH VERSATILE EXHAUST SYSTEM

(71) Applicant: LABCONCO CORPORATION, Kansas City, MO (US)

(72) Inventors: Jim Hunter, Olathe, KS (US); Mark S. Schmitz, Overland Park, KS (US); Michael Hays, Lee's Summit, MO (US); Brian D. Garrett, Olathe, KS (US)

(73) Assignee: LABCONCO CORPORATION, Kansas City, MO (US)

( * ) Notice: Subject to any disclaimer, the term of this patent is extended or adjusted under 35 U.S.C. 154(b) by 1065 days.

(21) Appl. No.: 14/688,093

(22) Filed: Apr. 16, 2015

Related U.S. Application Data

(63) Continuation-in-part of application No. 14/249,693, filed on Apr. 10, 2014.

(60) Provisional application No. 61/882,308, filed on Sep. 25, 2013.

(51) Int. Cl.

| | |
|---|---|
| ***B08B 15/02*** | (2006.01) |
| ***F24F 11/00*** | (2018.01) |
| ***F24F 11/72*** | (2018.01) |
| *F24F 11/52* | (2018.01) |
| *F24F 140/40* | (2018.01) |

(52) U.S. Cl.
CPC ..... *B08B 15/023* (2013.01); *F24F 11/0001* (2013.01); *F24F 11/72* (2018.01); *F24F 11/52* (2018.01); *F24F 2140/40* (2018.01)

(58) Field of Classification Search
CPC ..... B08B 15/02; B08B 15/023; F24F 11/72
USPC ..... 454/58
See application file for complete search history.

(56) References Cited

U.S. PATENT DOCUMENTS

| | | | | | |
|---|---|---|---|---|---|
| 3,397,631 | A * | 8/1968 | Simons | F24F 9/00 | 432/64 |
| 3,616,624 | A * | 11/1971 | Marsh | F24F 3/16 | 454/60 |
| 3,776,121 | A * | 12/1973 | Truhan | F24F 3/044 | 454/187 |
| 3,811,250 | A * | 5/1974 | Fowler, Jr. | B01D 46/00 | 454/56 |
| 3,944,405 | A * | 3/1976 | Van Calsteren | B08B 15/023 | 55/338 |
| 4,333,745 | A * | 6/1982 | Zeanwick | F24F 3/1607 | 451/453 |
| 4,436,022 | A * | 3/1984 | Zboralski | B08B 15/023 | 454/59 |

(Continued)

*Primary Examiner* — Helena Kosanovic
(74) *Attorney, Agent, or Firm* — Stinson LLP

(57) ABSTRACT

The biosafety cabinet has a frame, which defines an enclosed work area and a front access opening, and a work surface along the bottom of the work area. One or more intake openings are positioned along the front access opening adjacent the work surface, a recirculation duct is in fluid flow communication with the intake holes, a supply filter is in fluid flow communication with the recirculation duct, and a supply blower is positioned upstream from the supply filter in fluid flow communication with the recirculation duct. One or more exhaust openings extend along the work surface, wherein at least one exhaust opening is positioned adjacent the front access opening rearward of the intake holes. The exhaust openings are in fluid flow communication with an exhaust duct, an exhaust filter, and an integral exhaust blower.

30 Claims, 17 Drawing Sheets

(56) References Cited

U.S. PATENT DOCUMENTS 4,517,883 A * 5/1985 Levchenko ..... B08B 15/023 454/61
4,534,281 A * 8/1985 Parks ..... B08B 15/023 454/59
4,832,717 A * 5/1989 Peters ..... B08B 15/023 454/187
4,927,438 A * 5/1990 Mears ..... F24F 3/1607 454/56
4,934,256 A * 6/1990 Moss ..... B08B 15/023 454/61
5,083,558 A * 1/1992 Thomas ..... A61G 10/02 128/202.12
5,170,673 A * 12/1992 Ahmed ..... B08B 15/023 454/56
5,240,455 A * 8/1993 Sharp ..... B08B 15/023 454/343
5,295,902 A * 3/1994 Hock ..... B08B 15/023 454/57
5,470,275 A * 11/1995 Jacob ..... B08B 15/023 454/59
5,487,768 A * 1/1996 Zytka ..... B01D 46/0023 454/187
6,217,437 B1 * 4/2001 Murray ..... A01K 1/031 119/419
6,368,206 B1 * 4/2002 Hunter ..... B08B 15/023 312/209
6,461,233 B1 * 10/2002 Gilkison ..... B08B 15/023 454/56
6,506,109 B1 * 1/2003 Bastian ..... B08B 15/023 454/56
6,632,260 B1 * 10/2003 Siemers ..... B01D 46/0013 454/184
7,022,151 B2 * 4/2006 Ono ..... B01L 1/04 454/187
7,699,051 B2 * 4/2010 Gagas ..... F24C 15/2028 126/299 D
8,163,052 B2 * 4/2012 Ono ..... A47B 9/00 454/56
2003/0027513 A1 * 2/2003 Bastian ..... B08B 15/023 454/56
2005/0024216 A1 * 2/2005 Crooks ..... F24F 11/30 340/606
2007/0184769 A1 * 8/2007 Lin ..... B08B 15/02 454/57
2008/0278040 A1 * 11/2008 McCarthy ..... B01L 1/04 312/209
2008/0278042 A1 * 11/2008 McCarthy ..... B01D 46/0091 312/209
2011/0281514 A1 * 11/2011 Haugen ..... B08B 15/023 454/57
2014/0193039 A1 * 7/2014 Wexler ..... G01C 11/04 382/106
2015/0192313 A1 * 7/2015 Yokoi ..... B25J 21/02 454/187
2017/0361365 A1 * 12/2017 Singh ..... B08B 15/023

* cited by examiner

DETAIL A

BIOSAFETY CABINET WITH VERSATILE EXHAUST SYSTEM

CROSS-REFERENCE TO RELATED APPLICATIONS

This application claim priority to and is a continuation-in-part of U.S. patent application Ser. No. 14/249,693, filed on Apr. 10, 2014, which claims priority to U.S. Provisional Application Ser. No. 61/882,308, filed on Sep. 25, 2013, each of which is incorporated herein by reference in its entirety.

STATEMENT REGARDING FEDERALLY SPONSORED RESEARCH OR DEVELOPMENT

Not applicable.

BACKGROUND OF THE INVENTION

1. Field of the Invention

The present invention relates generally to biological safety cabinets.

2. Description of Related Art

Biological safety cabinets are laboratory containment devices typically equipped with High Efficiency Particulate Air (HEPA) filters. These cabinets are used in laboratories where microbiological and chemical materials are handled and provide a work area in a safe environment where a variety of experiments and studies can be performed. In addition to a ventilation hood above the work area, these cabinets provide a more protective working environment. Biosafety cabinets typically have a frame that encloses the work area on all but one side. The remaining side provides an access opening to the work area that can be closed in whole or in part via a movable sash. The sash may be moved upwardly to provide access to the work area so that work can be performed. The sash may be moved downwardly to partially or completely close the work area. A blower unit is provided in the cabinet above the work area to provide clean down flow air to the work area. The blower is used to circulate air downwardly through the work area. A portion of this downward air flow forms an "air curtain" at the front of the cabinet adjacent the access opening and passes beneath the work surface of the work area. Another portion of the downward air flow is directed to the back of the cabinet where it is then drawn upwardly through a plenum chamber. As the air moves downward through the work area, it may be contaminated by materials present within the work area. Therefore, prior to being exhausted into the room or a fume system, the air may be first passed through a HEPA exhaust filter.

The blower is of a size and powered to operate at a speed to provide sufficient air flow through the work area to insure that materials, including harmful contaminants, are contained within the work area and eventually passed to a filter area rather than escaping into the room or exhausted into the atmosphere. To this end, a portion of air is drawn into the safety cabinet at the front of the access opening formed when the sash is in an open or partially open position to block the outflow of air.

The amount of air drawn into the safety cabinet is in part dependent on the position of the movable sash as it determines the size of the access opening. Traditionally, safety cabinets are manufactured and calibrated to operate at or below a pre-determined maximum sash height. Typical sash heights are 8, 10, or 12 inches. A combination of detent mechanisms and alarm switches may be used to alert a user to the maximum operational sash height ("MOSH"). To change the MOSH, a cabinet technician moves the detents and switches and re-calibrates the cabinet to ensure proper airflow. Recalibration may include adjusting the speed of one or more blowers, adjusting the position of one or more dampers, or removing or inserting plugs into an exhaust filter cover.

The prior art safety cabinets are typically provided with a sash grill located below the sash. This sash grill forms the lower-most surface of the access opening into the work area. Typically, the sash grill is provided with a number of perforations through which air can flow. Inside the cabinet, a portion of air flows downwardly from the blower and into these perforations. Also, a portion of air is drawn from outside the cabinet and into these perforations. The air flows through the sash grill openings, under the work surface, and upwardly through a plenum at the back of the cabinet to be recirculated or exhausted. Particulate-free air flows downwardly from the supply HEPA filter. The front portion of this flow enters the sash grill. The rear portion flows into perforations near the lower-back of the work area and is drawn into a plenum chamber to be recirculated or exhausted.

Safety cabinets have conventionally been classified by "Type" based on the configuration of airflow within the cabinet as well as the final destination of the exhaust air. Type A2 biosafety cabinets ("BSCs") combine the mixed incoming air and down flow air and re-circulate approximately 70% of the combined air. The remaining air is exhausted after HEPA filtration, either back into the laboratory or via a building fume removal system.

Type B1 BSCs rely on a building exhaust system to draw air into the cabinet and are designed to exhaust a larger amount of the cabinet's air flow. The B1 BSCs typically separate the down flow air whereby the rear portion of the down flow air is ducted directly to the building exhaust system via the negative pressure created by the building exhaust blower. The front portion of the down flow air is combined with the incoming air at the front access opening and all or a portion of that air is recirculated. Overall, in a Type B1 BSC, typically 50-70% of the air flow is exhausted out of the building through the building exhaust system. One problem associated with the Type B1 BSC is that the portion of work area air flow that is exhausted at the back of the cabinet is not clearly delineated and can be difficult for a user to reach. For example, if users working with volatile materials do not want the air contaminants to be recirculated back into the work area, they must work in the rear half of the work area. This arrangement is not ergonomic and difficult to put into practice as the area where air is totally exhausted and not recirculated is not clearly defined.

Another type of cabinet, known as the Type B2 BSC, also must have a connection to a building exhaust system to pull air into the cabinet. All air entering the front access opening and all down flow air is exhausted. There is no recirculation. The "total exhaust" Type B2 cabinet is desired for use when the application prohibits the recirculation of volatile toxic chemicals. Type B2 BSCs have an internal blower only to provide sterile down flow air into the work area. They are completely reliant on the building exhaust system to draw air into the face of the cabinet through the access opening and exhaust air out of the cabinet. When connected to the building exhaust system, each cabinet typically has its own dedicated ducting. In rare circumstances, several Type B2 BSCs are connected to the same duct system and equipped with flow controls.

Type A2 BSCs provide the most economical alternative regarding capital investment, installation, and operating expenses. Installation costs include the financial requirements to supply and install ducting, wiring, and an exhaust blower. Type A2 BSCs, without connections to a building exhaust system, avoid the expenses associated with the ducting and roof exhaust blower. Type B1 and B2 BSCs must have exhaust ducting and an external blower to operate and therefore cost substantially more to install. Additionally, since a higher percentage of room air is continually being exhausted through the Type B1 and B2 cabinets, there is an operating expense associated with tempering (heating and cooling) the volume of air leaving the laboratory. Energy related expenses are currently a large concern and anticipated to increase. An exhausted BSC that could save energy would be highly desirable.

Related to the initial investment at installation, the building exhaust system connected to a Type B1 or B2 BSC must operate at a higher vacuum so as to effectively pull air through the HEPA filter media in the cabinets. A building exhaust system designed to operate at a higher vacuum requires larger diameter ducting and greater sized exhaust blowers, both of which can lead to additional expense.

As stated above, the Type B1 and B2 BSCs inflow rate (through the access opening of the cabinet) is regulated by the building exhaust system. Control of this rate is critical to the proper operation and containment of the BSC. Fluctuations in the building exhaust system can cause the BSC to have too much or insufficient inflow face velocity at the access opening. A drawback to connecting Type B1 and B2 cabinets to a system with other ventilation equipment (BSCs and fume hoods, fume extraction devices) are the flow variations presented by the vacuum requirements of the other equipment on the same system. For this reason, manufacturers recommend that Type B1 and B2 BSCs be connected to a dedicated exhaust duct and blower so that the BSC inflow is more constant. Unfortunately, these exhaust blowers are only adjusted periodically (annual validation) and as the HEPA filters become loaded with particulate, the flow rate through the exhaust blower and BSC is proportionately reduced over time. A safer, less maintenance intensive BSC would address the variations in flow rate posed by connection with other ventilated equipment and by filter loading.

Type B1 and B2 BSCs are required by internationally recognized standards to be equipped with an alarm system that monitors the exhaust flow. Since the operator's safety is reliant on the exhaust blower maintaining at least a minimum flow (typically about 100 ft/min or 0.50 m/sec), the B1 and B2 cabinets are calibrated to do two things when inflow is too low to contain biological or chemical hazards. The cabinet must provide an audible and visible alarm warning the operator of insufficient inflow. Secondly, the B1 and B2 BSCs must shut off the down flow blower. If there is a delay in shutting off the down flow while there is no longer building exhaust flow, the down flow can cause air and potentially hazardous materials from inside the work area to breach the access opening or front face of the cabinet and expose operators to contaminated air. Additionally, even if the working materials are not hazardous, they may be valuable and require protection from room contaminants. If the building exhaust system fails, the working materials are no longer protected by the sterile downward flowing air when the cabinet blower is shut off. An exhausted BSC design and control system that can ensure operator safety and prevent spoliation of valuable research materials in the event there is sudden failure of the building exhaust would be a great improvement over the prior art cabinets.

Type A2, B1 and B2 BSCs are designed and constructed differently such that they each must be used as the same type of cabinet throughout their operating life. Thus, a Type A2 cabinet cannot be converted for use as a Type B2 cabinet and a Type B2 cabinet cannot be converted to a Type A2 cabinet. If a laboratory equipped with a Type A2 cabinet begins working on applications that include volatile toxic chemicals that must be exhausted rather than recirculated, the owner must purchase and install a new Type B2 cabinet. Likewise, if an owner has a Type B2 cabinet and later does not require all air to be exhausted, they are committed to the much higher operating costs of tempering the supply air to the room. An ideal situation would be a type of BSC that can convert easily from one type to another.

BRIEF SUMMARY OF THE INVENTION

It is an object of the present invention to provide a biological safety cabinet having a novel airflow configuration that provides energy-savings, safer operation, and versatility in exhaust options than conventional BSCs.

It is another object of this invention to provide automatic means to continually self-adjust exhaust airflow on a ducted biological safety cabinet that permits connection to the laboratory's general exhaust system thereby minimizing variations in the cabinet's performance.

It is a further object of the invention to present the cabinet exhaust air to the exhaust system without requiring substantial vacuum such that the building exhaust system can be downsized for economical installation and operation.

It is a further object of the invention to provide automatic means for self-adjusting the exhaust blower to provide constant volume exhaust over time regardless of HEPA filter loading and pressure changes. Consequently, the cabinet inflow air volume remains relatively constant thereby providing safe, consistent containment of hazardous materials.

It is a further object of the invention to provide a clearly delineated work area so users understand what portions of the work area are immediately and totally exhausted and what areas are to be recirculated.

It is yet another object of the invention to provide a better solution for cabinet operation in the event that a building exhaust system fails suddenly. Instead of immediately shutting down upon exhaust system failure, the cabinet of the present invention is programmed to sustain the proper inflow air volume via an integral exhaust blower for a period of time to allow the operator to safely close containers, cover work product, and decontaminate the work area. In the event that a cabinet with a supply blower and an exhaust blower must cease operation, it is preferable that the blowers are shutdown sequentially so as to maintain negative pressure in the cabinet. In one embodiment, the supply blower is shutdown approximately 8-10 seconds before the exhaust blower is shutdown.

It is still another object of the present invention to have a BSC that can operate as a Type A2 cabinet, and, without construction changes, exhaust a portion of the air from a defined work area similar to a Type B cabinet. A biological safety cabinet in which the cabinet type can be easily converted to or from a Type A2 cabinet to a Type B cabinet may include software that controls the activation and deactivation of an intake flap switch and building exhaust performance alarm.

It is still another object of the present invention to provide a programmable BSC for the activation and deactivation of alarm switches corresponding to more than one maximum operational sash height.

A biological safety cabinet in accordance with the present invention includes a frame defining an enclosed work area and a front access opening for user access to the work area. A work surface positioned along a bottom of the work area extends from the front access opening to a back wall. One or more intake openings are positioned along the front access opening in front of the work area in fluid flow communication with a recirculation duct. The recirculation duct is in fluid flow communication with a supply blower positioned upstream from a supply filter. The supply blower is adapted to supply filtered down flow air to the work area. One or more exhaust openings extend along a portion of the work surface, at least one of which is positioned adjacent the front access opening rearward of the intake openings. An exhaust duct is in fluid flow communication with the exhaust openings and an exhaust filter through which air is filtered before exiting the cabinet. Preferably, the cabinet additionally includes an integral exhaust blower in fluid flow communication with the exhaust filter. In one embodiment, the integral exhaust blower is downstream of the exhaust filter and is preferably configured to be releaseably secured in fluid flow communication with an external ventilation system such that filtered air exiting the exhaust blower is directed to the external ventilation system and exhausted outside the laboratory facility when secured to the ventilation system. In an alternative embodiment, the integral exhaust blower is upstream of the exhaust filter and the cabinet preferably includes an exhaust conduit extending from the exhaust filter that is configured to be releasably secured in fluid flow communication with the external ventilation system to exhaust filtered air outside the laboratory facility when secured to the ventiliation system.

In one embodiment, the biological safety cabinet includes a frame that defines an enclosed work area with an access opening presented on one side for access to the work area. A sash coupled to the frame may be moved upward to permit access to the work area through the access opening and can be moved downward to close or partially close the access opening. A supply blower positioned upstream of a supply filter is adapted to pull intake air into the cabinet, provide clean down flow air to the work area and circulate air through the work area so that harmful materials are confined within the cabinet and moved away from the work area for filtration. A sash grill positioned below the sash includes one or more intake openings for air flow to a recirculation duct. A work surface extending below the work area from the front of the cabinet adjacent the sash grill to the back of the work area is separated into two or more sections. Exhaust openings delineate the work surface sections having air flow that will be exhausted versus airflow recirculated within the cabinet. By only exhausting a portion of the air, the volume of room air exhausted by the cabinet of the present invention is significantly lower than Type B2 prior art cabinets thereby offering energy savings. The portion of the work area that has airflow directed to the building exhaust is filtered and conveyed by an integral exhaust blower to the building duct work. The integral exhaust blower is adapted to exhaust a relatively constant volume of air despite variations in the building exhaust or due to filter loading.

In another embodiment, the biosafety cabinet includes a frame defining an enclosed work area having a top wall, a back wall, two side walls, and a front access opening for user access to the work area. A work surface is positioned along a bottom of the work area extending from the front access opening to the back wall. Intake holes positioned along the front access opening adjacent the work surface, are in fluid flow communication with a recirculation duct. A supply filter is in fluid flow communication with the recirculation duct and a supply blower is positioned upstream from the supply filter in fluid flow communication with the recirculation duct, wherein the supply blower is adapted to supply filtered down flow air to the work area. A plurality of exhaust holes positioned along or adjacent the work surface are in fluid flow communication with an exhaust duct and an exhaust filter. At least one of the exhaust holes is positioned adjacent the front access opening rearward of the intake holes and more preferably the exhaust holes are positioned in the work surface to provide an exhaust zone that extends from the front of the work area to the back of the work area. This exhaust zone can comprise the entire work area so that any down flow air through the work area is exhausted or can comprise only a portion of the work area such that the total amount of air exhausted is reduced. Furthermore, the exhaust holes may be positioned in a line or row in series in the work surface to provide a clearly delineated exhaust work area in which the user can work.

The biosafety cabinet may also include back holes positioned along a portion of the back wall or in the work surface adjacent a portion of the back wall in fluid flow communication with the exhaust duct and/or the recirculation duct. Additionally, side holes may be positioned along the side walls or in the work surface adjacent the side walls in fluid flow communication with the exhaust duct and/or the recirculation duct. A gap may also be provided between the side walls and the work surface in fluid flow communication with the exhaust duct and/or the recirculation duct.

In a most preferred embodiment, two lines of exhaust holes are provided extending from the front to the back of the work surface, wherein the area extending between the lines of exhaust holes defines an exhaust zone. Optionally the cabinet additionally includes a line of exhaust holes positioned along a front of the work surface within the exhaust zone rearward of the intake holes and/or includes back vent holes positioned along a portion of the back wall adjacent the exhaust zone or in the work surface adjacent a back of the exhaust zone in fluid flow communication with the exhaust duct.

Back vent holes may also be positioned along a portion of the back wall outside the exhaust zone or in the work surface adjacent a portion of the back wall outside the exhaust zone in fluid flow communication with the recirculation duct. A movable sash may be positioned in the access opening configured to be moved to open and close or partially close the access opening and a sash grill may be positioned along a front of the cabinet below the sash, wherein at least a portion of the intake holes are formed within the sash grill.

In a preferred embodiment, the cabinet additionally includes an integral exhaust blower in fluid flow communication with the exhaust filter. In one embodiment, the exhaust blower is secured to the frame, adjacent the top of the cabinet, and downstream of the exhaust filter. In this embodiment, the integral exhaust blower is adapted to draw air from the exhaust duct through the exhaust filter. A duct collar extending from the exhaust blower is configured to be releasably secured in fluid flow communication with an external ventilation system such that air exiting the exhaust blower may be directed through the external ventilation system to outside the laboratory. In another embodiment, the integral exhaust blower is positioned upstream of the exhaust filter and is adapted to draw air from the exhaust duct and blow it through the exhaust filter and an exhaust conduit, which is releasably secured in fluid flow communication with an external ventilation system, such that filtered air is directed through the external ventilation system to outside the laboratory. In either embodiment, the blower preferably comprises a variable speed motor that is preferably a programmable, variable speed motor configured to pull or push a substantially constant volume of air through the exhaust filter. The speed of the motor may be dynamically adjusted so that the blower draws or blows air through the exhaust filter at a substantially constant volume notwithstanding any increased resistance to airflow. In a preferred embodiment, a substantially constant volume of air is exhausted by programming the motor to increase the speed of blower wheel to compensate for any increased resistance to airflow attributable to contaminants accumulating within the filters. In addition, the cabinet may include an alarm that is triggered if the external ventilation system fails. If the alarm is triggered, the motor is programmed to maintain the appropriate volume of inflow and continue to force air out of the cabinet into the ventilation system ductwork for a period of time so that the user can take appropriate action. In a most preferred embodiment, the motor comprises an ECM motor such as a General Electric ECM Series motor or Genteq ECM motor, although other motors could also be used in accordance with the present invention.

In another embodiment, the cabinet is programmed to receive a selected maximum operational sash height. The cabinet activates the sash alarm switch for the selected sash height and deactivates all other sash height alarm switches. If the alarm switch is triggered, an audible alarm sounds and a visual message appears indicating that the sash is at a height above the selected maximum operational sash height.

Additional objects, advantages, and novel features of the invention will be set forth in part in the description which follows, and in part will be apparent to those skilled in the art upon examination of the following, or may be learned from practice of the invention.

Additional aspects of the invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means of the instrumentalities and combinations particularly pointed out in the appended claims.

DETAILED DESCRIPTION OF PREFERRED EMBODIMENT

Figure 1:
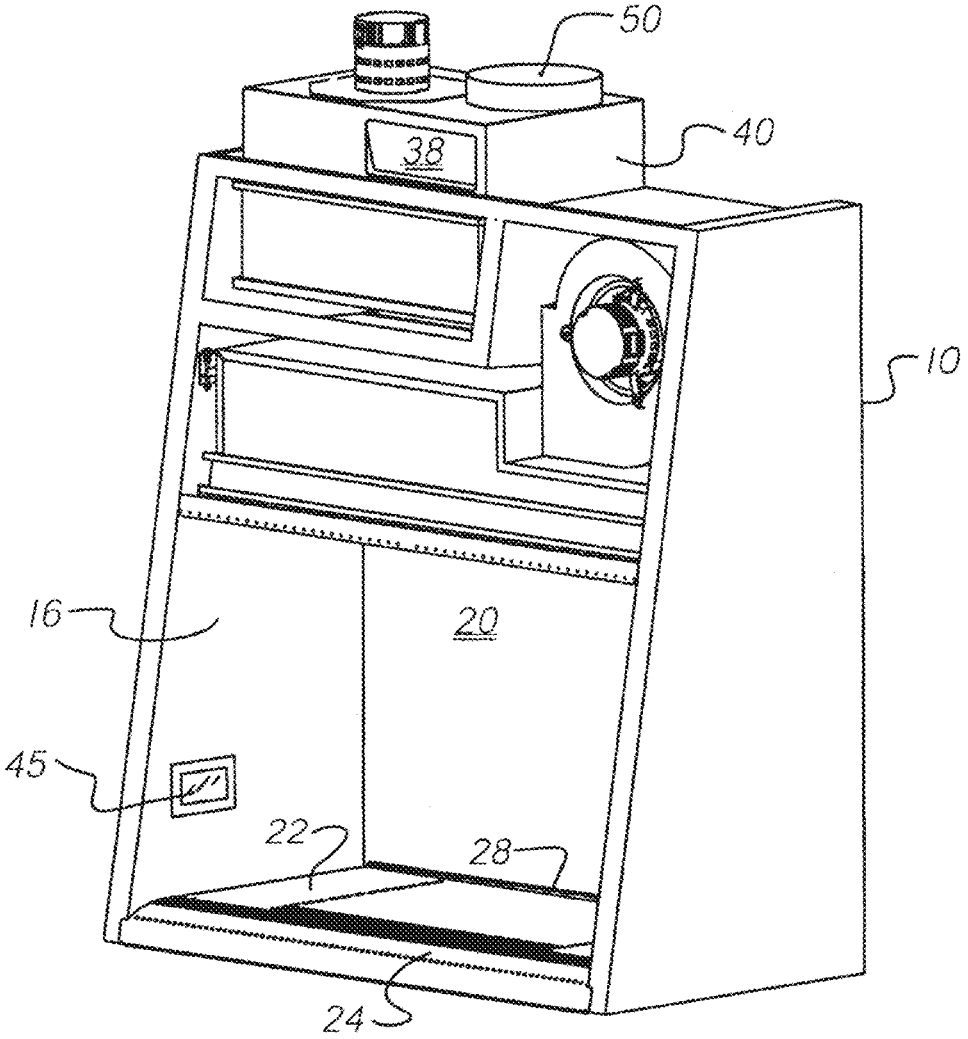
FIG. 1 is a perspective view of a biosafety cabinet in accordance with an embodiment of the present invention with the face of the cabinet removed to show the internal construction of the upper cabinet details (the base and/or legs of the cabinet are not shown).
Figure 2:
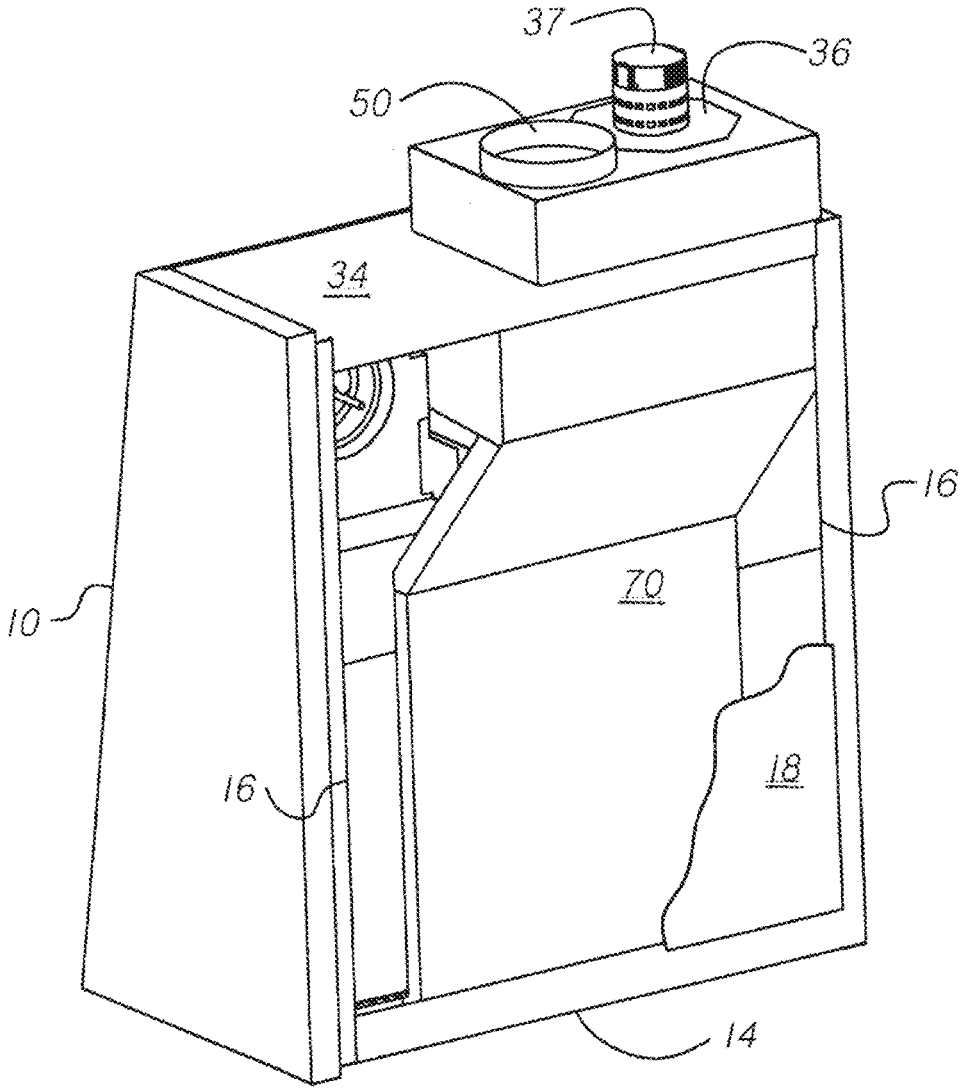
FIG. 2 is a rear perspective view of the cabinet of FIG. 1 with the back panel cut away to show the exhaust duct separated from the recirculation duct.
Figure 4:
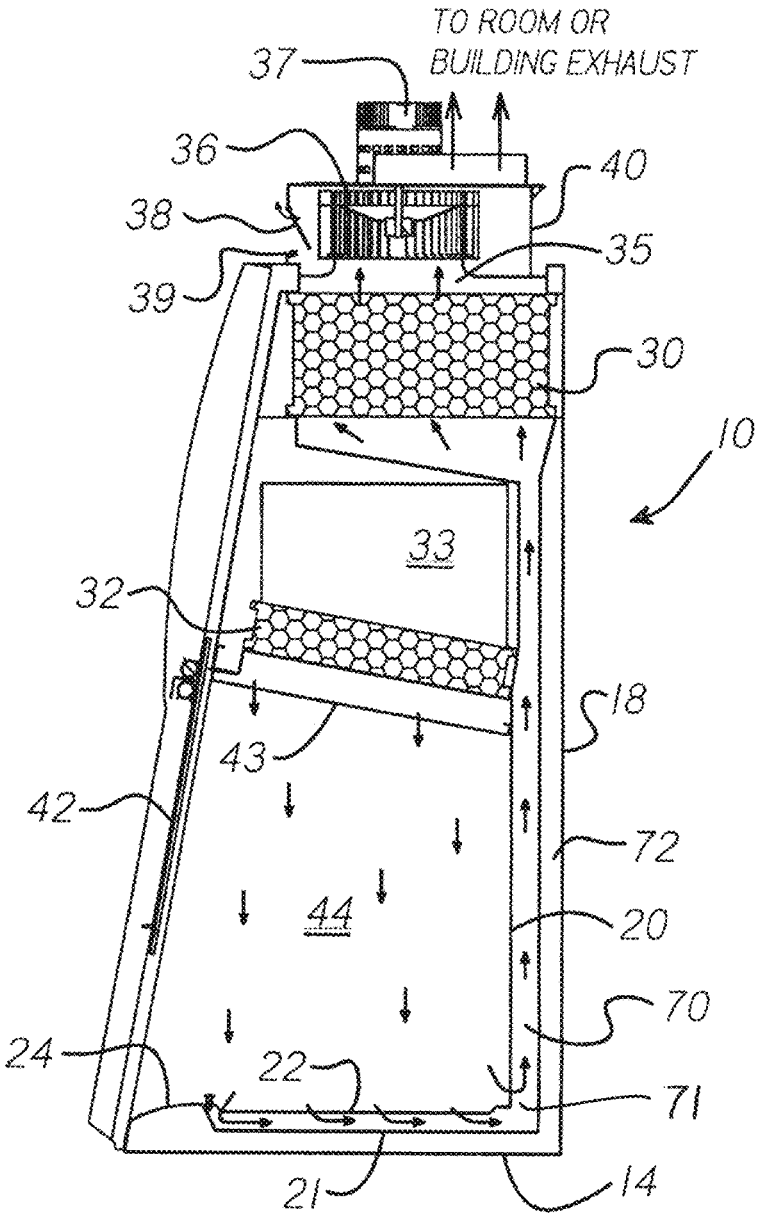
FIG. 4 is a cross sectional side view of the cabinet of FIG. 1 showing the flow of air captured in the exhaust zone of the work area and conveyed through the exhaust duct to the exhaust filter.

Referring initially to FIGS. 1, 2, and 4, a biological safety cabinet according to the present invention is designated in the drawings by the reference numeral 10. Cabinet 10 has a bottom panel 14 and a pair of upwardly extending opposing side panels 16 which are rigidly coupled to bottom panel 14, such as by welding. Extending upwardly from the bottom panel 14 and rigidly coupled between side panels 16 is a rear panel 18, as best seen in FIGS. 2 and 4. Side panels 16 and rear panel 18 extend upwardly from bottom panel 14 to top panel 34. Bottom panel 14, side panels 16, rear panel 18 and top panel 34 form a partial frame in which other components of cabinet 10 are held. A baffle 20 extends between side panels 16 and is spaced inward from rear panel 18. The bottom of baffle 20 is spaced a distance above bottom panel 14. Panels 14, 16, 18, and 34, as well as baffle 20, are preferably made from metal such as stainless steel.

Figure 8:
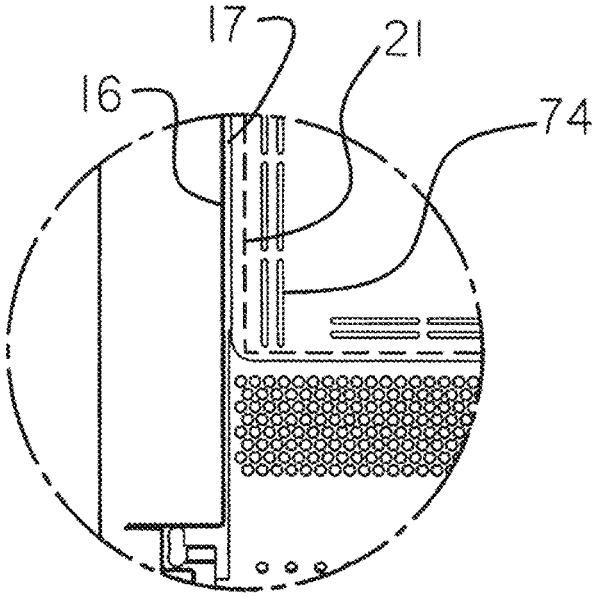
FIG. 8 is a cross sectional top view of an alternative biosafety cabinet showing an alternative arrangement of the "exhaust zone" and "recirculation zone" airflow openings where the entire work surface comprises an "exhaust zone". A detailed view A is provided to show the position of the exhaust pan relative to the exhaust holes and the edge of the work surface.
Figure 8:
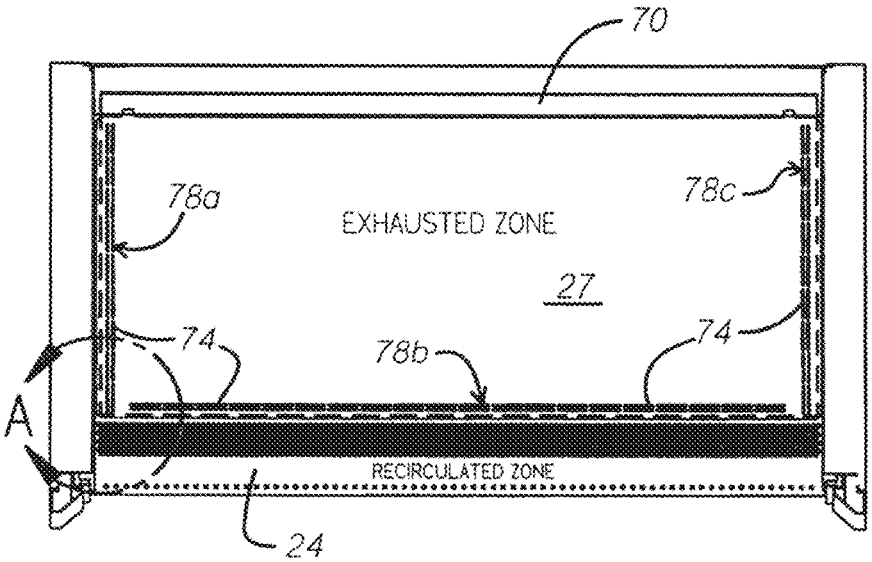

A work surface 22 is suspended above bottom panel 14 and spaced apart from side panels 16 to create an air recirculation gap 17 (best seen in FIG. 8 Detail A). Work surface 22 is used to hold the objects necessary to perform experiments within cabinet 10, such as beakers, flasks and other conventional lab ware. Work surface 22 may be fabricated from a single piece of metal or of several separate pieces. Extending generally along the front of cabinet 10 between side panels 16, and extending forward from work surface 22 to bottom panel 14, is a sash grill 24.

Figure 3:
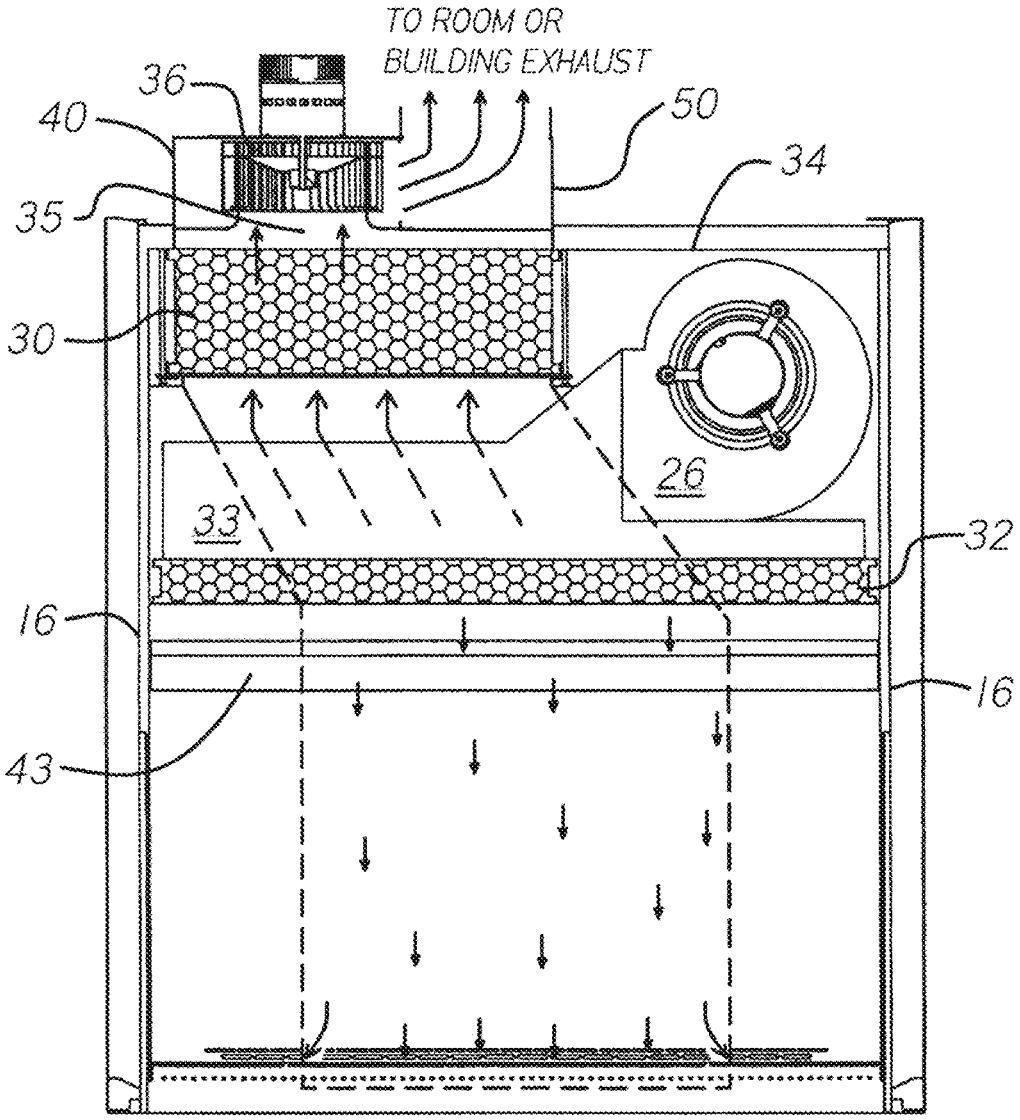
FIG. 3 is a cross sectional front view of the cabinet of FIG. 1 which shows with arrows the route of down flow air that is captured in the "exhaust zone" of the work area and conveyed through the exhaust duct to the exhaust filter.
Figure 5:
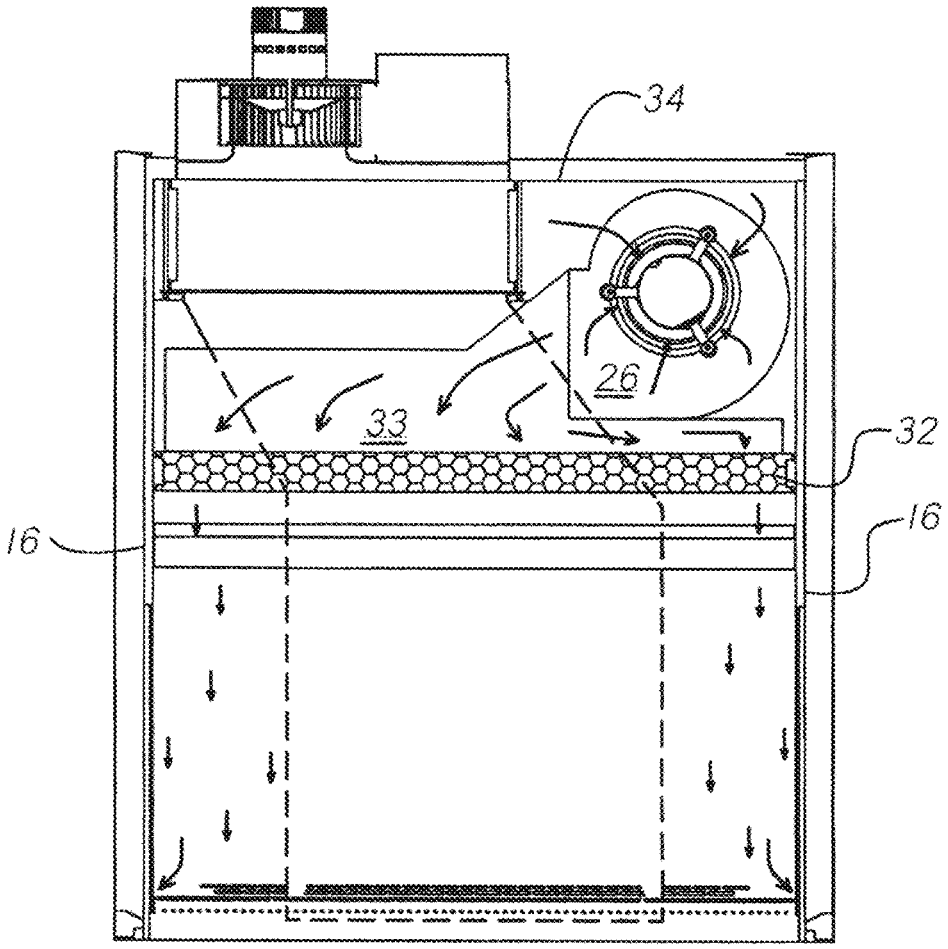
FIG. 5 is a cross sectional front view of the cabinet of FIG. 1 which shows with arrows the route of inflow and down flow air that is captured in the "recirculation zone(s)" of the work area and conveyed through the recirculation duct to the supply blower.

As best seen in FIGS. 3 and 5, a supply blower 26 is located in the upper part of cabinet 10. Upper cabinet components include supply blower 26, exhaust filter 30, supply filter 32 and plenum box 33, which is in communication with the supply blower outlet. Top panel 34 extends from rear panel 18 to the front of the cabinet and between side panels 16. An integral exhaust blower 36 is coupled to top panel 34 via a collar-shaped opening in top panel 34 that permits fluid flow communication from exhaust filter 30 to exhaust blower 36. An enclosed exhaust air space 35 is defined between the top of exhaust filter 30, the bottom of top panel 34, and exhaust blower 36. An exhaust housing 40 is coupled to top panel 34 and forms a box shaped cover over exhaust blower 36 and over an additional portion of top panel 34. Duct collar 50 extends upwardly along the outer perimeter of an opening in the top of housing 40 in fluid flow communication with exhaust blower 36. A movable sash 42 (FIGS. 4 & 6) is mounted between side panels 16 in a manner allowing it to be moved upwardly and downwardly. Work surface 22, baffle 20, side panels 16 and an air diffuser plate 43 below supply filter 32 form a protective work area 44 within which work can be performed.

Figure 6:
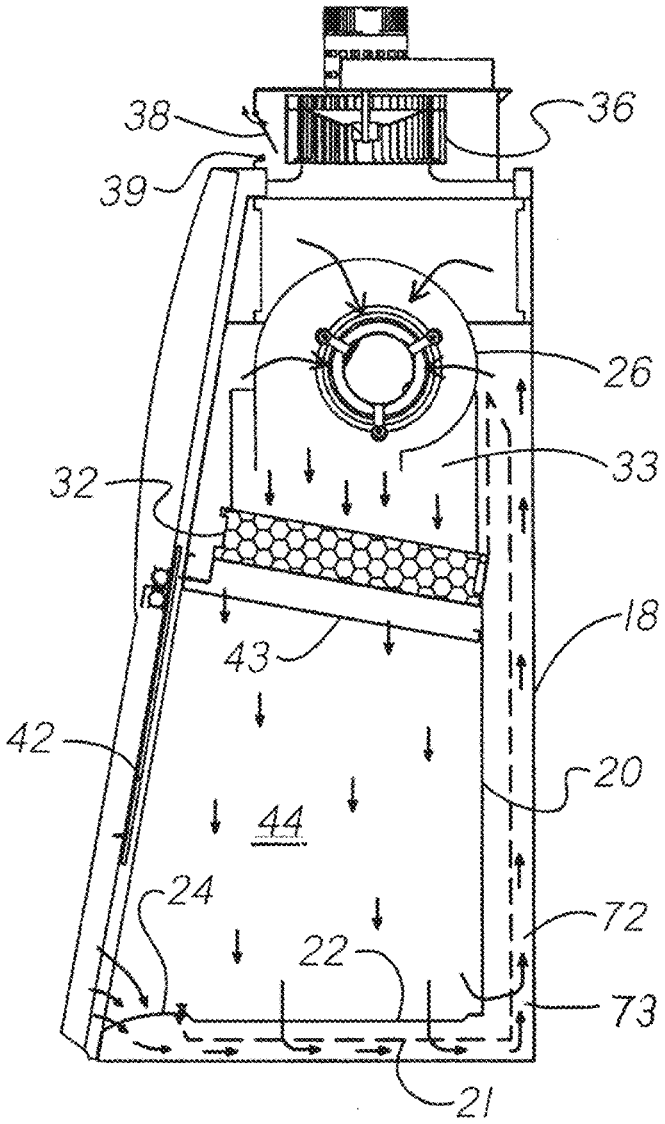
FIG. 6 is a cross sectional side view of the cabinet of FIG. 1 showing the flow of air captured in the recirculation zone and conveyed through the recirculation duct to the supply blower.

In use, supply blower 26 is operated to provide downward air flow through the cabinet, and particularly through work area 44. Prior to entering the work area 44, the air is first passed through supply filter 32, preferably a HEPA filter, to remove any contaminants. Cabinet 10 may be operated with sash 42 located a specified distance away from sash grill 24, as is shown in FIGS. 4 and 6. To ensure that contaminants do not escape through the opening between sash 42 and grill 24, blower 26 will direct air downwardly along the rear surface of sash 42 and into the perforations of grill 24 from above the work area to provide a protective curtain of air that facilitates containment within work area 44. A portion of the air from blower 26 also moves toward the rear of work surface 22 as will be explained hereinafter. The action of the supply blower 26 and the integral exhaust blower 36 provide a certain amount of suction, causing an air flow inwardly along the opening defined by the bottom of sash 42, side panels 16 and sash grill 24. All the air drawn through this opening passes through the perforations in sash grill 24.

Figure 7:
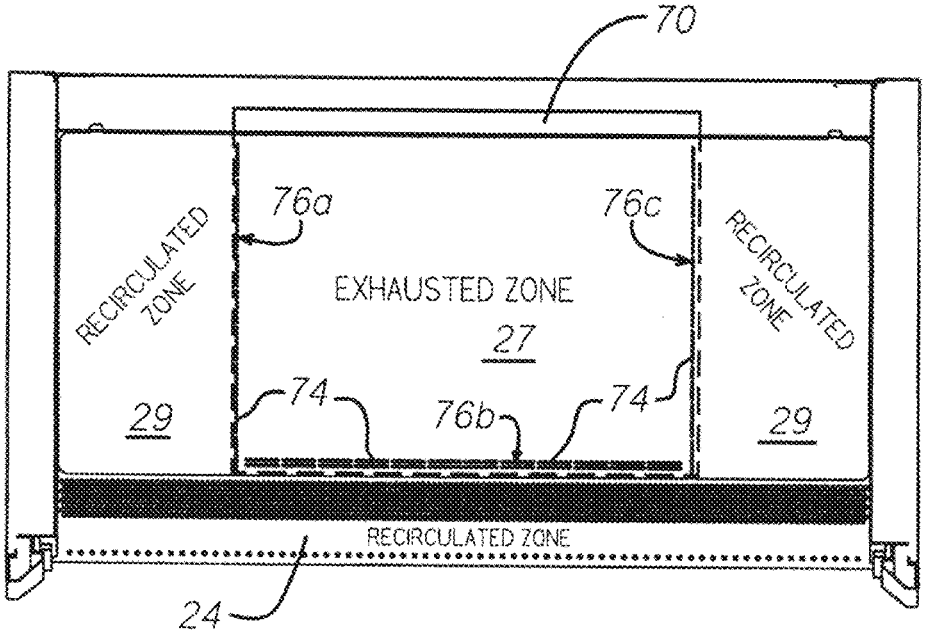
FIG. 7 is a cross sectional top view of the cabinet of FIG. 1 showing a preferred work area with an "exhaust zone" and "recirculation zone" defined by air flow openings.

As best seen in FIG. 7, work surface 22 is separated into zones with the center portion of the work surface extending from the front to the back of the work surface identified as a total "exhaust zone" 27. Air from the supply filter 32 and diffuser plate 43 moving down through the portion of work area 44 is captured in exhaust perforations or holes 74 extending through work surface 22 surrounding the "exhaust zone" 27. Exhaust holes 74 are presented adjacent one another to form three lines 76*a*, 76*b*, 76*c* of holes in the work surface that border or delineate exhaust zone 27. In practice, this air may contain particulate and volatile toxic chemicals that are not to be recirculated in the cabinet. Through exhaust holes 74, the exhaust zone 27 of the work surface 22 is in fluid flow communication with an exhaust zone pan 21 (shown in dashed lines in FIG. 7 and visible in FIG. 4) extending under exhaust zone portion of the work surface. Exhaust zone pan 21 has front and side walls that extend upwardly a distance from the bottom of the pan. The top of the front and side walls are secured in abutting engagement with the bottom of work surface 22 so as to define an enclosed space between the work surface and the exhaust zone pan. The front and sidewalls of exhaust zone pan are positioned outside the front and outer edges of holes 74 so that the holes are in fluid flow communication with the enclosed space formed by the pan and the work surface. The back of exhaust zone pan is open and positioned in fluid flow communication with a rear exhaust duct 70 (best seen in FIGS. 2 and 4) extending from the bottom of pan 21 behind baffle 20 to the top of cabinet 10. Air transported from exhaust zone 27, through holes 74, and into exhaust zone pan 21 is directed up a rear exhaust duct 70 to exhaust filter 30. The exhaust zone pan 21 and rear exhaust duct 70 together define a separate exhaust duct 71 that is not in fluid flow communication with air that is being recycled through the cabinet.

Work surface 22 can accommodate a variety of exhaust/recirculation zone configurations. Preferably, 60-70% of work surface 22 is within the exhaust zone. For example, a cabinet having a 4-foot wide work surface includes a 30 inch wide exhaust zone. In an alternative embodiment, exhaust zone 27 can be maximized to the entire work surface 22 as shown in FIG. 8 wherein three lines of exhaust holes 78*a*, 78*b*, 78*c* are presented in the work surface along the front and sides of the work surface. In this embodiment, the exhaust zone pan (shown in dashed lines) extends below the entire work surface. As shown in Detail A from FIG. 8, the perimeter of pan 21 runs outside of exhaust holes 74 but inside the edge of work surface 22. In this manner, air traveling down from supply blower 26 and outside of exhaust zone 27 is passed through gap 17 between the lateral edges of work surface 22 and side panels 16. Despite this small portion of air traveling down side panels 16 that is recirculated, this embodiment is effectively a total exhaust system for all available work space.

Figure 9:
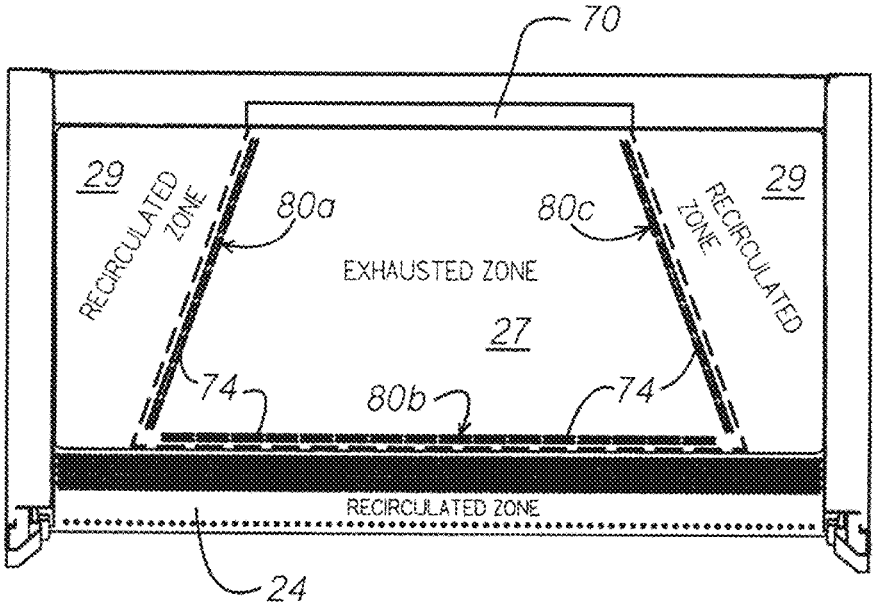
FIG. 9 is a cross sectional top view of the cabinet of FIG. 1 showing an alternative work area with an "exhaust zone" and "recirculation zone" defined by air flow openings.
Figure 10:
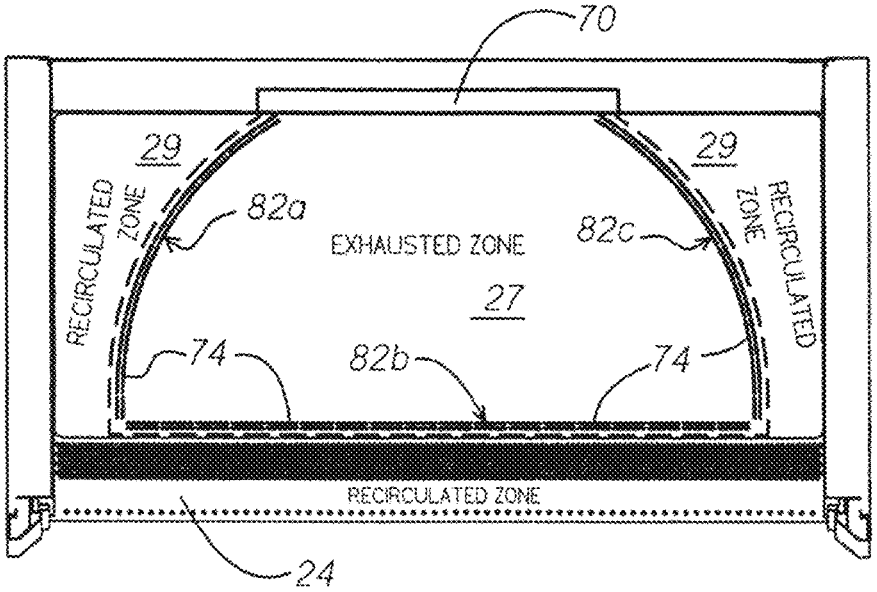
FIG. 10 is a cross sectional top view of the cabinet of FIG. 1 showing an alternative work area with an ergonomic "exhaust zone" and "recirculation zone" defined by air flow openings.

In a further embodiment shown in FIG. 9, exhaust zone 27 is wider near the front of work surface 22 and narrows as it approaches the rear, all as delineated by exhaust hole lines 80*a*, 80*b*, and 80*c*. In yet another embodiment shown in FIG. 10, exhaust zone is ergonomically shaped and is delineated by exhaust hole lines 82*a*, 82*b*, and 82*c*. In each exhaust/recirculation zone configuration, exhaust zone pan 21 (shown in dashed lines in FIGS. 7-10) is sized and shaped to direct air traveling through exhaust holes 74 to rear exhaust duct 70 without introducing a significant amount of flow resistance.

Preferably in each of the embodiments mentioned above, rear exhaust holes 28 (shown in FIG. 1) are also presented along at least a portion of the bottom of the back wall of the cabinet. In the embodiments shown in FIGS. 4, 6, 7, 9, and 10, air entering the rear exhaust holes in the exhaust zone is directed to the rear exhaust duct and air entering the rear exhaust holes outside the exhaust zone is directed to the recirculation duct 73 (shown in FIG. 6). In the embodiment of FIG. 8, all of the air entering the rear exhaust holes is directed to the exhaust duct 71 (shown in FIG. 4).

Continuing with the exhaust flow best shown in FIG. 4, air from the exhaust zone 27 flows from the rear exhaust duct 70 through the exhaust filter 30, preferable a HEPA filter. Particulates are removed from the airstream in exhaust filter 30 and volatile vapors passing through the filter are directed into enclosed space 35 above filter 30. Housing 40 is equipped with a flow valve 38 to indicate negative pressure as well as allow a small amount of make-up air to be introduced. The make-up air allows for fluctuations in room or duct pressure so that exhaust blower 36 can deliver a constant volume of air to the exhaust stream. In a ducted system without a flow valve, sudden pressure fluctuations could overcome or restrain the blower and temporarily interrupt the flow of exhausted air. Preferably, flow valve 38 includes a moveable door or flap and a switch for providing feedback to a control system indicating whether the flap is in an open position or a closed position. The flap is held in an open position when the building exhaust or external ventilation system is operational, i.e., pulling between 3-10% of the total volume of exhaust air through the exhaust blower. If the building exhaust or external ventilation system fails or the rate of exhausted air drops below 80% of the normal operational flow rate, the flap will move to the closed position and trigger the switch.

Figure 16:
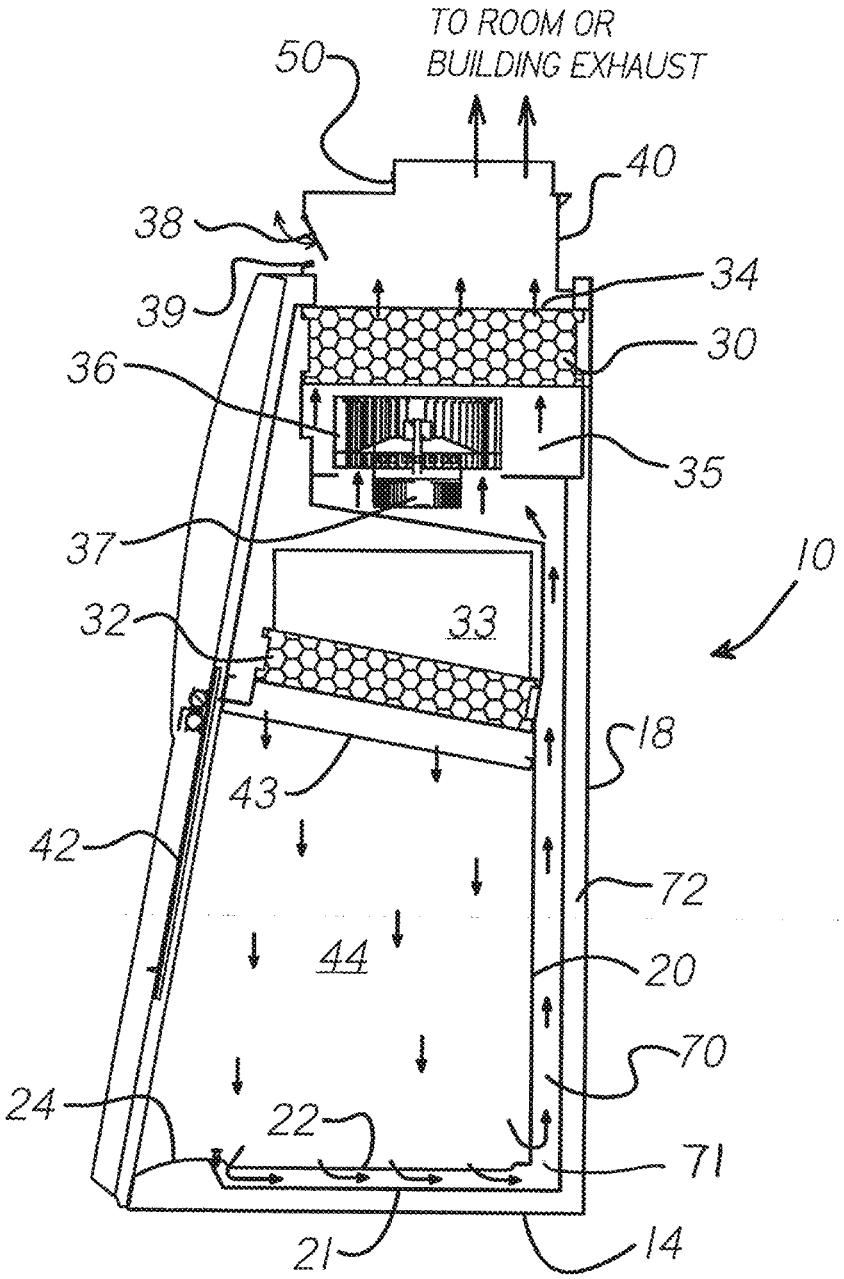
FIG. 16 is a cross sectional side view of the cabinet of FIG. 15 showing the flow of air captured in the exhaust zone of the work area and conveyed through the exhaust duct to the exhaust filter.
Figure 17:
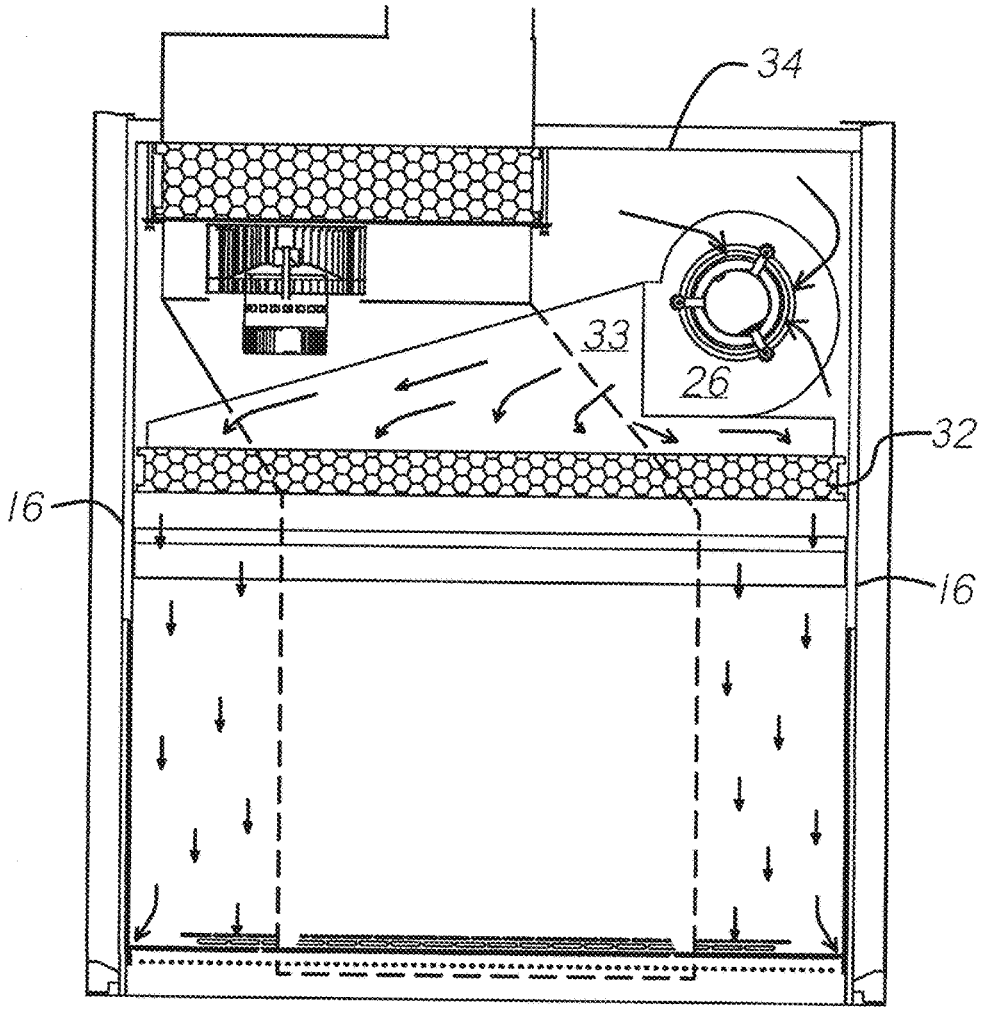
FIG. 17 is a cross sectional front view of the cabinet of FIG. 15 which shows with arrows the route of inflow and down flow air that is captured in the "recirculation zone(s)" of the work area and conveyed through the recirculation duct to the supply blower.

The exhaust blower 36 shown in FIG. 4 is positioned downstream of exhaust filter 30. In an alternative embodiment shown in FIGS. 15-17, exhaust blower 36 is positioned upstream of exhaust filter 30. In this alternative embodiment, integral exhaust blower 36 is between and in fluid flow communication with rear exhaust duct 70 and exhaust air space 35. Exhaust air space 35 is defined beneath exhaust filter 30 and surrounds exhaust blower 36. Exhaust housing 40 is coupled to top panel 34 and forms a box-shaped cover over exhaust filter 30. Duct collar 50 extends upwardly along the outer perimeter of an opening in the top of housing 40 in fluid flow communication with exhaust filter 30. With regard to the exhaust flow shown in FIG. 15, air from the exhaust zone 27 flow is pulled through rear exhaust duct 70 and into exhaust air space 35 by exhaust blower 36. The exhaust air then passes through exhaust filter 30, preferable a HEPA filter. Particulates are removed from the airstream in exhaust filter 30 and volatile vapors passing through the filter are directed into the space enclosed by exhaust housing 40 above filter 30. When housing 40 is attached to a building exhaust system via duct collar 50, the air is exhausted outside the laboratory environment. Similar to the embodiment described with reference to FIG. 4, housing 40 is equipped with a flow valve 38 to indicate negative pressure as well as allow a small amount of make-up air to be introduced. If the building exhaust or external ventilation system fails or the rate of exhausted air drops below 80% of the normal operational flow rate, the flap will move to the closed position and trigger an alarm switch. One advantage to positioning exhaust blower 36 upstream of exhaust filter 30 is the overall height of the cabinet is reduced, which may be beneficial in certain confined laboratory spaces. Additionally, the cabinet can be accurately scanned for leaks using standard techniques known in the art. An exhaust blower positioned upstream of the exhaust filter allows for 100% scanning of the filter.

The integral exhaust blower motor 36 is preferably a commercially available energy efficient blower having a motor with electronic intelligence capable of maintaining constant volume flow. The blower preferably comprises a variable speed motor that is preferably a programmable, variable speed motor configured to exhaust a substantially constant volume of air. In a preferred embodiment, moving a substantially constant volume of air is achieved by programming the motor to increase the speed of the blower wheel to compensate for any increased resistance to airflow attributable to contaminants accumulating within the various filters positioned in the air flow pathway in the cabinet. In a preferred embodiment, motor 37 comprises a Genteq ECM motor, although other motors could also be used in accordance with the present invention. The motor can be programmed to follow a torque curve and supply the proper RPMs to move a constant volume of air despite variations presented by the building exhaust system or the loading of the exhaust filter 30. Other motors and pressure and/or flow sensing devices could be used as alternative methods to accomplish this. Additionally, a less effective method would use a constant speed motor/blower in this application.

Looking to the recirculated airflow and recirculation duct 73 best shown in FIG. 6, the air drawn through front sash grill 24 travels beneath work surface 22, beneath exhaust zone pan 21 and through the plenum defined by the rear wall of baffle 20 and rear panel 18 as it is drawn upwardly by blower 26. This intake air is not mixed with the air in exhaust zone 27 that travels through exhaust zone pan 21 and up rear duct 70. The down flow air from the supply filter that is outside exhaust zone 27 is designated to be in a recirculation zone 29 best seen in FIG. 7. The air drawn through the holes in work surface 22 outside exhaust zone 27 and air passing through gap 17 between the lateral edges of work surface 22 and side panels 16 is mixed with the intake air from the sash grill 24 and travels under work surface 22, around exhaust zone pan 21, and up back channel 72 of the cabinet (outside the rear exhaust duct 70). This air is recirculated through the supply blower 26 and supply filter 32.

Decontamination and cleaning of safety cabinet 10 is essential. Work surface 22 is positioned above bottom panel 14 and extends from the rear edge of sash grill 24 to the bottom of back baffle 20. Exhaust zone pan 21 is easily removable from under work surface 22 for cleaning and sanitation. The surfaces of work surface 22 and exhaust zone pan 21 can be made from a material such as stainless steel and may be held in place through the use of removable fasteners that require no tools. The portion of work surface 22 within exhaust zone 27 may be flat and in the same plane as the portion of work surface 22 within recirculation zone 29. Alternatively, the portion of work surface 22 within exhaust zone 27 may be concave or dish-shaped to contain a liquid spill.

Cabinet 10 is preferably programmable and has an internal control system. The control system includes hardware (including a circuit board and power supply) and software all as known in the computing and programmable device arts. The cabinet control system may optionally be in communication with other control systems, including a building monitoring system or remote cabinet monitoring system. Cabinet 10 preferably includes a display 45 (see FIG. 1) for communicating visual messages and alerts to a user. As described in further detail below, the control system of cabinet 10 can be programmed to monitor and adjust certain features of cabinet 10, communicate visual and audio alarms or other messages to a user, and initiate startup and shutdown sequences.

Supply motor blower 26 is programmed to deliver an industry acceptable air flow rate through the supply filter established by a qualified technician through the cabinet's software. The preferred air flow rate through supply filter 32 is one that generates a downward laminar flow of at least 55 ft/min. Likewise the integral exhaust blower motor 37 is programmed to move the proper volume of air to maintain the specified rate of air entering the sash opening of the work area 44. The preferred air flow rate entering the sash opening is at least 100 ft/min. The preferred components and controls are commercially available ECM motors as described earlier with built-in intelligence. The application of this technology or similar combinations of sensors and motors on the downstream side of the exhaust HEPA filter is novel in the industry. Prior art cabinets utilized blowers on the upstream side of an exhaust filter, however these prior arrangements did not permit an integral exhaust blower to communicate directly with building exhaust duct pressures, thereby not taking advantage of the constant self-adjusting nature of the intelligent blower motor. Problems with the prior art cabinet's inability to adjust resulted in fluctuating cabinet inflows as well as improper flow rates due to changes in the building exhaust system.

Figure 11:
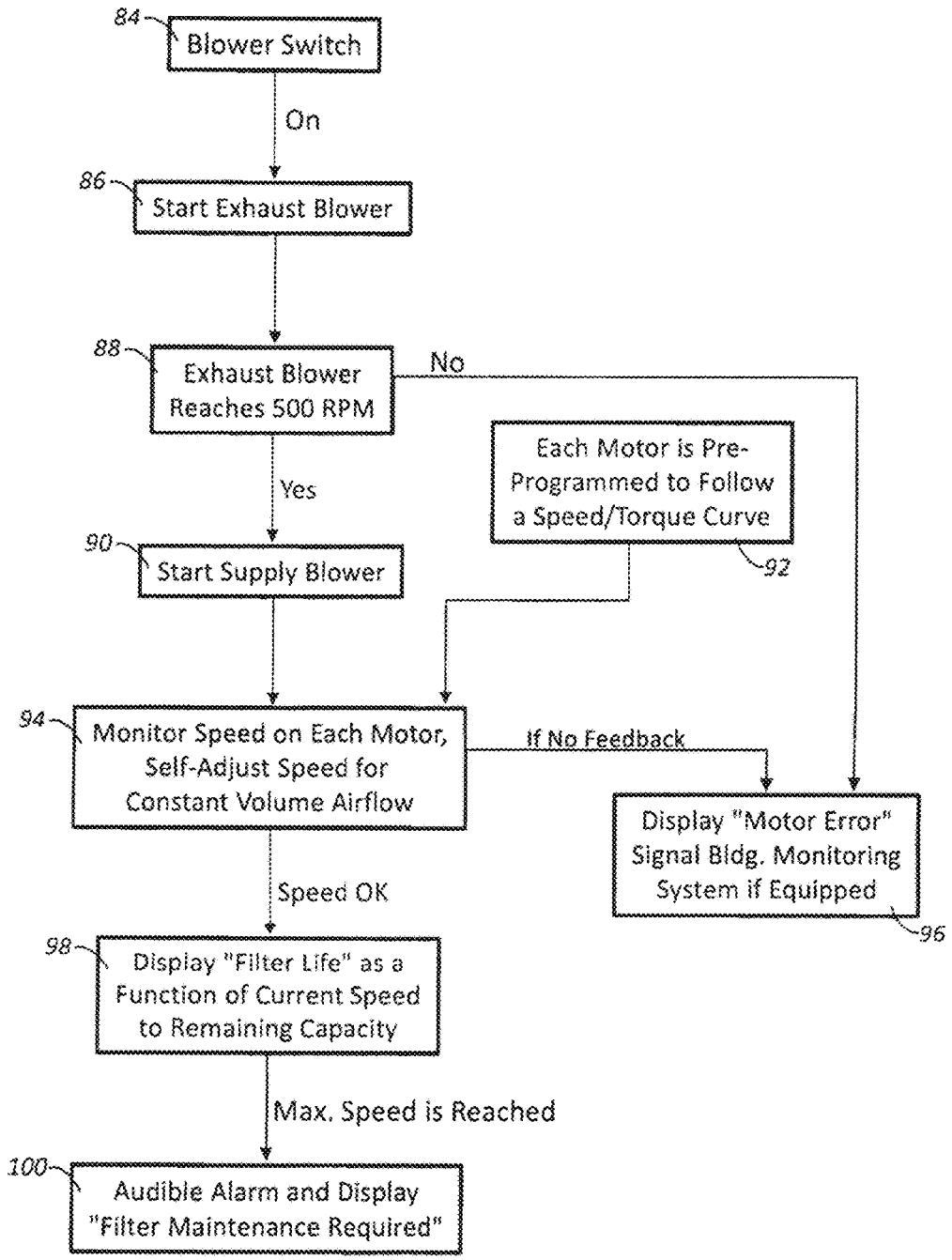
FIG. 11 is a process flow diagram of a method of operating the exhaust and supply blowers in accordance with an embodiment of the present invention.

With reference to FIG. 11, a method of operating supply blower 26 and exhaust blower 36 in accordance with a preferred embodiment is shown. After the blower switch is activated at block 84, exhaust blower 36 turns on at block 86. Once exhaust blower 36 reaches 500 RPM at block 88, supply blower 26 starts at block 90. As described above, each blower is preferably equipped with a programmable motor. As indicated at block 92, these motors have been pre-programmed to follow a speed/torque curve. During operation at block 94, the motors dynamically monitor changes in torque and respond by adjusting fan speed to ensure that a constant volume of air is moved. Each motor electronically signals its respective speed in revolutions per minutes or RPMs to the cabinet's control circuit board. This speed information serves two purposes: first, it indicates whether the motor is operating normally; and second, it is used to calculate the remaining filter life (i.e., how loaded the filter is with particulate). If no speed feedback is provided, the cabinet will display a message indicating motor error at block 96. Optionally, a building monitoring system may also be signaled at block 96. If speed feedback is provided, a filter-life indicator is displayed on the cabinet at block 98. Filter life is displayed as a function of current speed to the remaining capacity to increase fan speed. When the maximum speed has been reached, an audible alarm will sound and the cabinet will display a message that the filter requires maintenance.

Returning to the connection with the building exhaust system, an improvement over conventional BSCs is the ability to be ducted into "ganged" exhaust systems. Ganged systems are any combination of fume hoods, BSCs and other ventilation collectors connected to central exhaust manifolds in the building's structure. Typical Type B1 and B2 BSCs do not operate properly in ganged exhaust systems because of fluctuating demands for exhaust air resulting in cyclical exhaust vacuums and volumes. In typical Type B BSCs, the safety and containment are directly reliant on the building exhaust vacuum and volume. Type B BSCs that exhaust outside the laboratory environment are required to be equipped with an alarm to warn the operator and shut down the cabinet in the event the building exhaust volume fails to meet a minimum level. The monitoring for the exhaust alarm can be accomplished in a variety of ways; pressure sensors, velocity transducers, sail switches or switch activated air valves. FIG. 4 shows a flow valve 38 that opens to allow a small portion of room air to enter only if the exhaust housing remains at a negative pressure. If the building exhaust system fails or is insufficient, the flow valve door 38 closes and activates an alarm condition. The novel placement of the integral exhaust blower 36 downstream from the exhaust filter 30 permits the exhausted BSC to be directly connected to ganged building exhausts since the integral exhaust blower 36 self-adjusts for variations. This feature is of importance to laboratory designers. There is a great deal of cost avoidance if the BSCs no longer require dedicated exhaust ducts and roof blowers. Larger facilities prefer fewer large laboratory exhaust systems that are easier controlled, maintained and designed as opposed to numerous single exhaust runs throughout the utility chases. Since the integral exhaust blower 36 pushes the BSC exhaust into the building exhaust system, there is less demand on the building exhaust when compared to conventional Type B BSCs. The reduction in static pressure requirements allows for smaller ducts and reduced building exhaust horsepower thereby lowering initial capital and installation costs.

A further advancement is the energy savings derived from this new air flow configuration. As mentioned earlier, Type B1 cabinets must rely on the building exhaust system and are balanced to remove from the building approximately 50-70% of the cabinet's air flow. The present invention clearly defines the area where an operator can be assured that the vapors from the work area are entirely exhausted. In the preferred arrangements, the exhaust zone 27 is located in the center of work area 44, logically where one would find it most advantageous to perform lab procedures. This convenience was not possible in conventional Type B1 cabinets. In Type B2 BSCs all air entering the work area 44, below the sash 42, above the sash grill 24 and between the sides 16, as well as all down flow air is exhausted. There is no recirculation. The present invention saves energy-related costs (as compared to conventional Type B2 BSCs) related to tempering room air that is exhausted.

The exhaust volume (cfm) is greatly reduced using the cabinet of the present invention from that of a convention Type B2 cabinet. Conventional Type B2 cabinets have an exhaust volume ranging from 650-1250 cfm depending on the size of the cabinet. Corresponding cabinets of the present invention will have an exhaust volume ranging from 250-500 cfm. Thus, the exhaust volume of a cabinet in accordance with the present invention may be about 35-40% less than a conventional total exhaust cabinet. Similarly, the starting and loaded vacuum required by a cabinet in accordance with the present invention may range from 0.1-0.3 and preferably is about 0.2 inches $H_2O$, whereas the starting vacuum for Type B1 and B2 cabinets ranges from 0.4 to 2.5 inches $H_2O$ and the loaded vacuum ranges from 2.4-4.5 inches $H_2O$. Lastly, depending on size of the cabinet, the horsepower required by the remote external blowers typically ranges from 0.5-1.5 for Type B1 cabinets and typically ranges from 1.0-3.0 in Type B2 cabinets. In contrast, the horsepower needed for the integral blower of a cabinet in accordance with the present invention ranges from 0.25-0.75.

Figure 15:
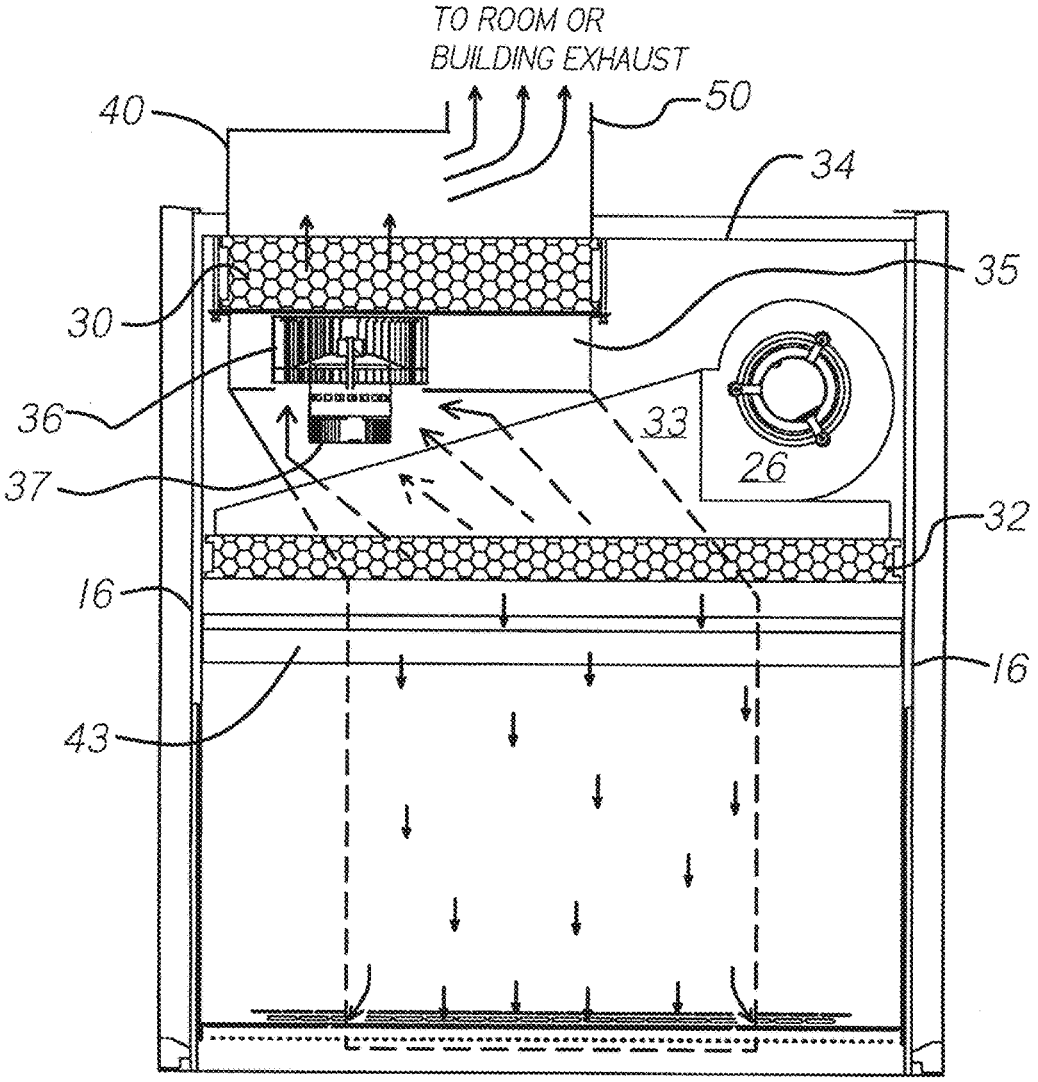
FIG. 15 is a cross sectional front view of a biosafety cabinet in accordance with an alternative embodiment of the cabinet of FIG. 1, wherein the exhaust blower is positioned upstream of the exhaust filter as opposed to downstream; arrows show the route of down flow air that is captured in the "exhaust zone" of the work area and conveyed through the exhaust duct to the exhaust filter.

Looking to FIG. 4 or FIG. 15, this invention responds to building exhaust flow alarms in an unconventional manner. The air valve 38 on the exhaust housing 40 closes when the building exhaust fails or is insufficient to move the required volume of air through the internal blower. The door on the air valve 38 is equipped with a switch 39, which signals the cabinet's control system to go into alarm mode when the door closes. Traditionally cabinets were programmed or wired to stop operating within seconds of going into alarm mode. In a preferred embodiment of the present invention, the cabinet's integral exhaust blower 36 is instead programmed to adjust to maintain the proper inflow air volume for a period of time when in alarm mode. In addition, audible and visual alarms notify the operator of a problem and to take proper action. This solves the long standing problem during shut-down, when cabinet down flow momentarily exceeds the building exhaust rate causing potentially hazardous air exiting the face of the cabinet. If the integral exhaust blower 36 is adjusted appropriately, air containment will be maintained at the face or access opening of the cabinet during the alarm mode.

Figure 12:
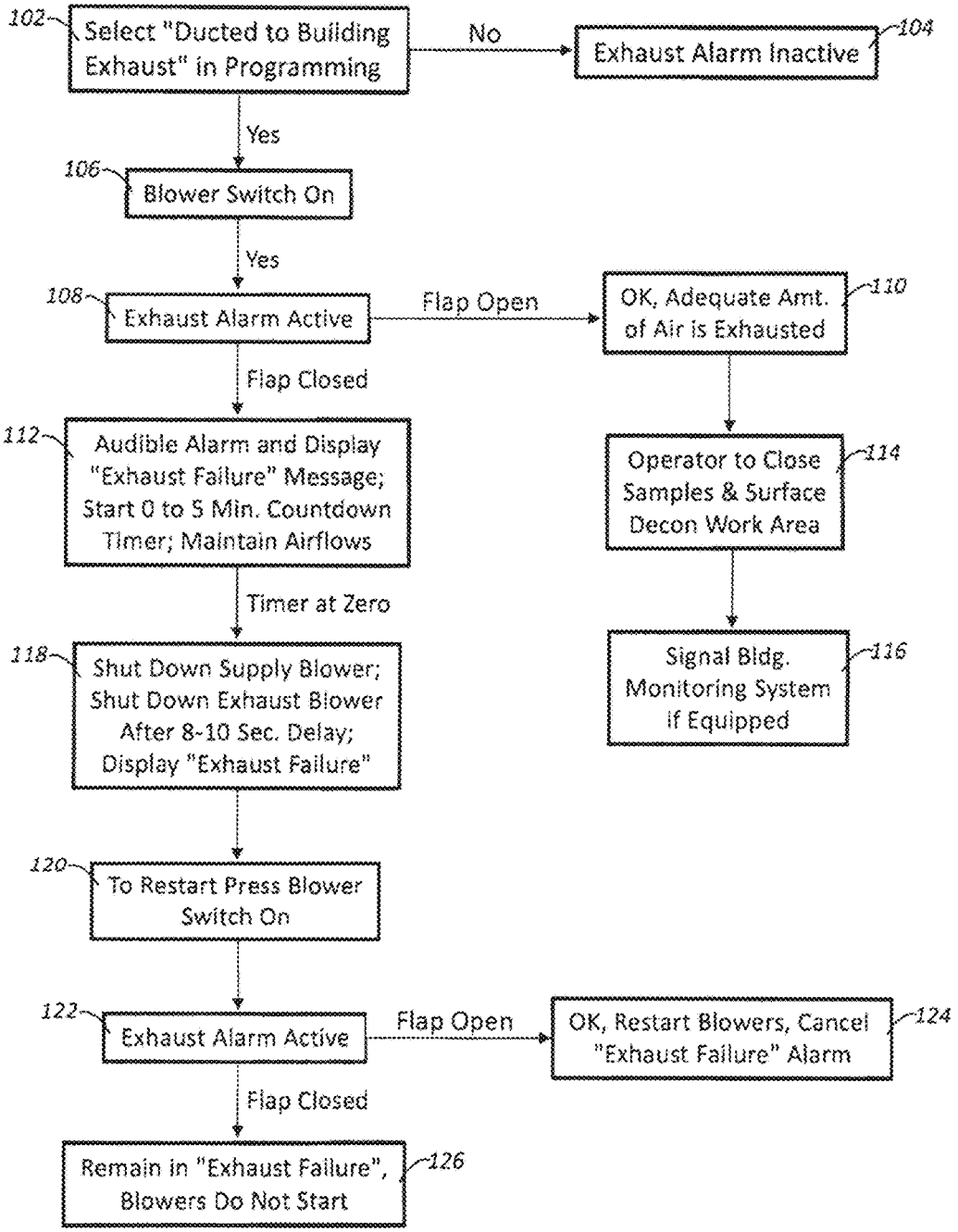
FIG. 12 is a process flow diagram of a method of operating an exhaust alarm system in accordance with an embodiment of the present invention.

With reference to FIG. 12, a method of monitoring the exhaust system when cabinet 10 is selectively connected to the building exhaust system in accordance with a preferred embodiment is shown. At block 102, the control system receives input as to whether the cabinet is ducted to the building exhaust. If the cabinet is not connected in this way, it essentially operates like a Type A2 cabinet and the exhaust alarm system is inactivated at block 104. If the cabinet is connected to the building exhaust system, it essentially operates like a Type B cabinet and after the blowers are switched on at block 106, the exhaust alarm is activated at block 108. When the exhaust alarm is active and the flap on flow valve 38 is open, the system feedback at block 110 is that an adequate amount of air is being moved through the exhaust system and operation of the cabinet can continue. If the flap closes, an audible alarm sounds and the cabinet displays a message that there is an exhaust failure at block 112. In addition, a countdown timer is displayed and begins to run. The countdown timer may be programmed to start between zero and five minutes. The timer starting point will be determined based on intended application of the cabinet. Under some circumstances, it may be desirable to provide the maximum amount of time to allow the lab worker to decontaminate the area and preserve working materials before the blowers shutdown. In other circumstances, it may be desirable not to blow exhausted air into a static building exhaust system and the timer will be programmed to start at zero (effectively eliminating the delay between exhaust failure and blower shutdown process). Preferably, the lab supervisor performs a risk assessment depending on the work subject matter and sets the timer in a password protected part of the cabinet control program. When the countdown timer is at zero, the cabinet displays a message that there has been an exhaust failure at block 118. In addition, the supply blower is shut off, and after a short delay (approximately eight to ten seconds), the exhaust blower is shut off. The delay between shut off of the supply and exhaust blowers ensures that the volume of air flowing down through the work area is exhausted or dissipated by the exhaust blower, thereby further protecting the lab worker from contamination. The staggered supply blower and exhaust blower shutdown sequence may be implemented in any cabinet having both a supply blower and an exhaust blower, regardless of the blower positions with respect to the filters. Delaying shutdown of the exhaust blower until after the supply blower ensures that the cabinet maintains negative pressure, which prevents contaminants from escaping out of the work area through the front access opening. Additionally, although alerting a user to an impending shutdown and displaying a timer until the blowers are shutoff has been described with reference to a cabinet with both supply and exhaust blowers, these features could also be implemented in a typical Type A cabinet having only a supply blower. In this manner, a user would be warned of an impending shutdown and could close containers or secure working samples before the supply blower was shut off.

With further reference to FIG. 12, the process for restarting operation of the cabinet starts at block 120 where the blower switch is switched on. This reactivates the exhaust alarm system at block 122. If the flap is open, the supply and exhaust blowers are restarted and the exhaust failure alarm or message are cancelled at block 124. If the flap remains closed, the cabinet remains in a state of exhaust failure at block 126 and the blowers will not restart.

A unique feature and advantage of the invention can be seen in the ability to convert from a Type A2 to or from a new style of Type B exhausted cabinet at any time desired. If the exhaust collar 50 is connected to a building exhaust system the cabinet can be operated as a new style Type B cabinet. As explained above, the exhaust alarm circuit can then be activated via a programmed setting. Unlike other traditional BSCs, if the type of work application changes, the lab supervisor has the ability to disconnect the building exhaust system, and change the programmed settings for it to function as a Type A2 cabinet.

Figure 13:
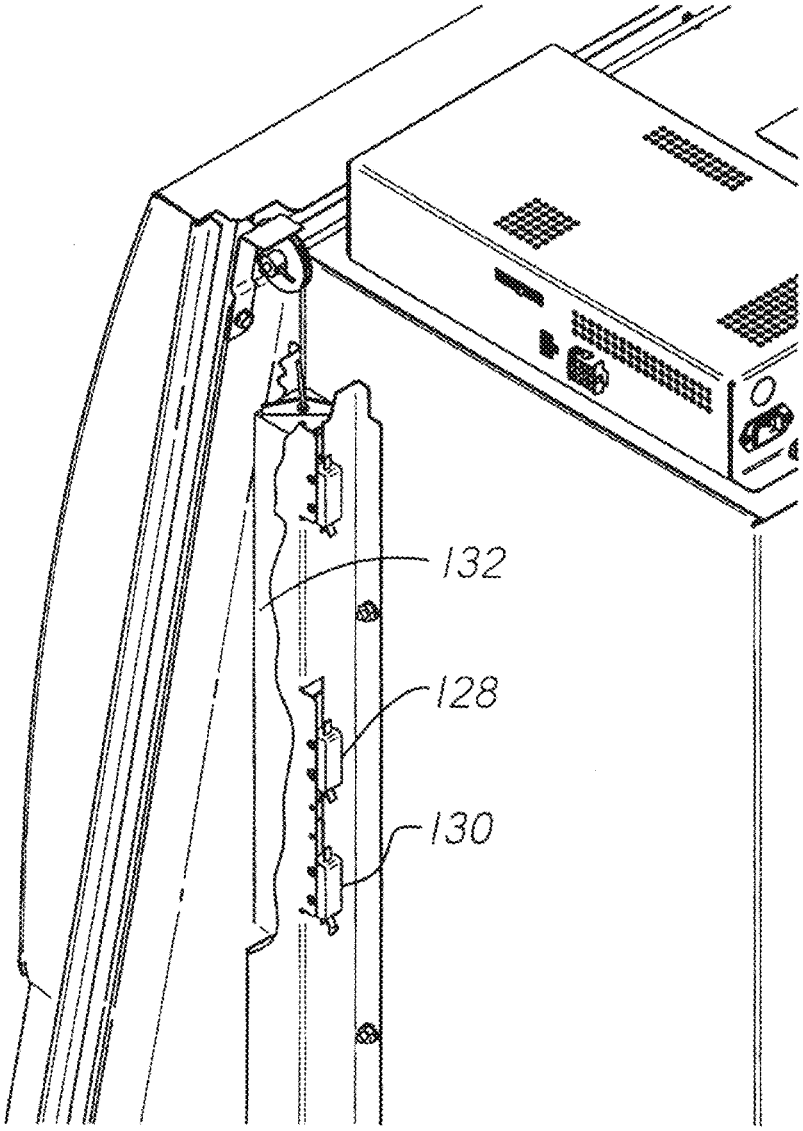
FIG. 13 is a rear perspective view of the side of a cabinet in accordance with an embodiment of the present invention where the counterweight channel has been cut away to show the sash counterweight relative to the sash alarm switches.

In a preferred embodiment, cabinet 10 is equipped to operate at one of two sash heights, i.e., an 8-inch maximum operational sash height or a 10-inch maximum operational sash height. Alternatively, a third or any number of additional sash height options could be provided, such as a 12 inch maximum operational sash height. As shown in FIG. 13, an 8-inch alarm switch 128 and a 10-inch alarm switch 130 are provided. A sash counterweight 132 moves via a cable and pulley system in response to movement of sash 42. Preferably, alarm switches 128 and 130 are normally open switches that are triggered when there is no longer contact with sash counterweight 132. Other types of switches or sensors commonly known in the art may alternatively be used.

Figure 14:
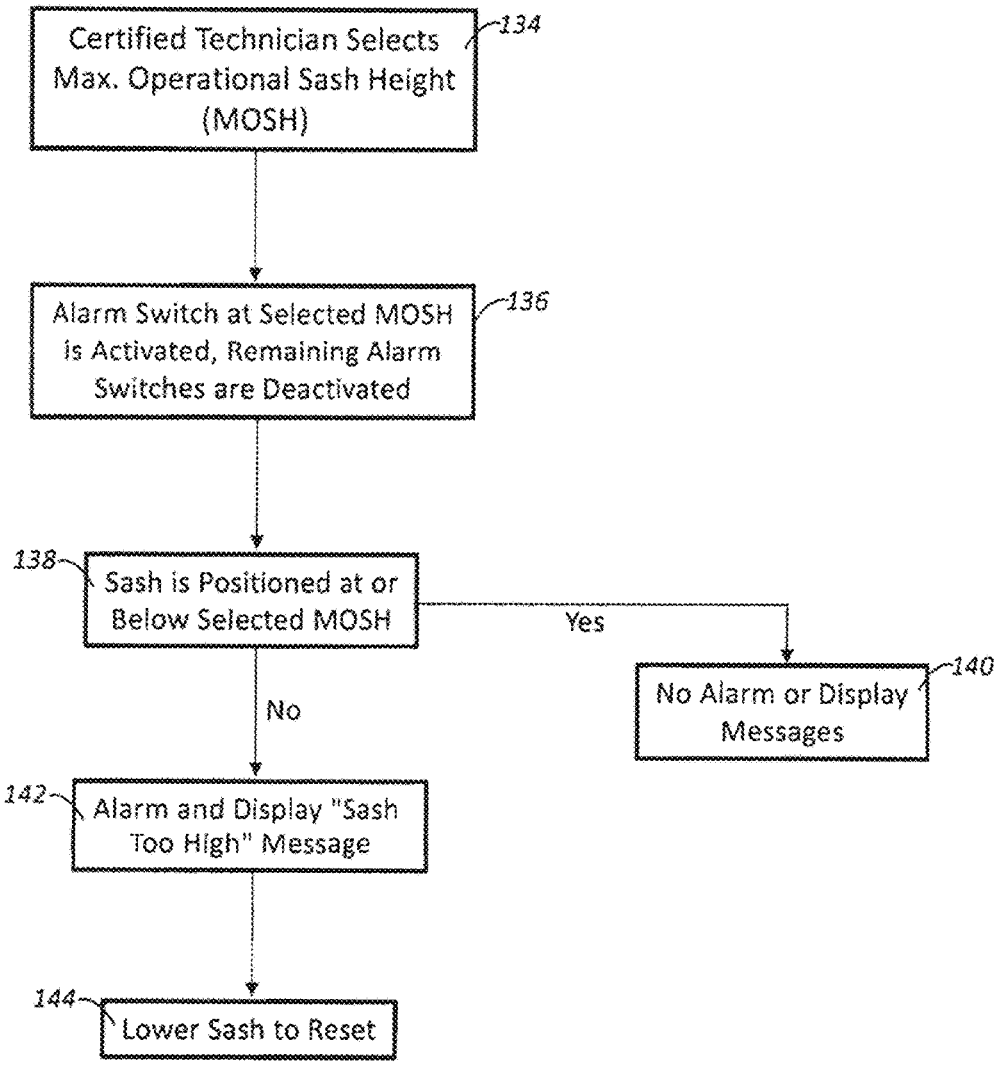
FIG. 14 is a process flow diagram of a method of programming a sash height in accordance with a preferred embodiment of the present invention.

Alarm switches 128 and 130 are activated or inactivated in accordance with the method shown in FIG. 14. At block 134, a certified cabinet technician selects the maximum operational sash height or MOSH. The technician then adjusts the exhaust blower speed to create the desired air flow rate during operation of the cabinet at the MOSH. At block 136, the alarm switch at the selected MOSH is activated and the remaining sash alarm switches are deactivated. When the cabinet is in operation at block 138 and the sash is positioned at or below the selected MOSH, the activated alarm switch is in the closed position. Subsequently, no alarm or message is displayed on the cabinet as depicted at block 140. If the sash is positioned above the selected MOSH, the activated alarm switch moves to an open position and an alarm sounds and the cabinet displays a message that the sash is too high at block 142. To reset the system and cancel the alarm and message at block 144, the sash must be lowered to or below the MOSH.

As can be seen from the above, the invention provides a biological safety cabinet with a number of improved features that solve several problems inherent in all prior BSCs. From the foregoing, it will be seen that this invention is one well adapted to attain all of the ends and objects herein above set forth, together with other advantages which are inherent to the structure. It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

What is claimed and desired to be secured by Letters Patent is as follows:

1. A biosafety cabinet comprising:

a frame defining an enclosed work area, said frame having a back wall and defining a front access opening for user access to the work area;

a work surface positioned along a bottom of the work area extending from adjacent the front access opening to said back wall;

one or more intake openings positioned along the front access opening in front of said work surface;

a recirculation duct in fluid flow communication with said intake openings;

a supply filter in fluid flow communication with said recirculation duct;

a supply blower positioned upstream from said supply filter in fluid flow communication with said recirculation duct, wherein said supply blower is adapted to supply filtered down flow air to the work area;

one or more exhaust openings extending along a portion of the work surface, wherein at least one of said one or more exhaust openings is positioned adjacent the front access opening rearward of the intake openings;

an exhaust duct in fluid flow communication with said exhaust openings, wherein said exhaust duct is separate from said recirculation duct and configured such that down flow air entering the exhaust duct through said one or more exhaust openings remains separate from down flow or recirculating air flowing through said recirculation duct; and an exhaust filter in fluid flow communication with said exhaust duct.

2. The biosafety cabinet of claim 1, wherein said cabinet additionally comprises an integral exhaust blower in fluid flow communication with said exhaust filter.

3. The biosafety cabinet of claim 2, wherein said cabinet is configured to be connected to an external ventilation system.

4. The biosafety cabinet of claim 2, wherein said integral exhaust blower is positioned downstream of said exhaust filter and adapted to draw air from said exhaust duct through said exhaust filter.

5. The biosafety cabinet of claim 3, wherein said integral exhaust blower is positioned downstream of said exhaust filter and adapted to draw air from said exhaust duct through said exhaust filter.

6. The biosafety cabinet of claim 5, wherein said cabinet further comprises an exhaust conduit extending from said exhaust blower, said exhaust conduit configured to be releasably secured in fluid flow communication with said external ventilation system such that filtered air exiting the exhaust blower is directed to said external ventilation system and exhausted outside the laboratory when said conduit is secured.

7. The biosafety cabinet of claim 2, wherein said integral exhaust blower is positioned upstream of said exhaust filter and adapted to blow air through said exhaust filter.

8. The biosafety cabinet of claim 3, wherein said integral exhaust blower is positioned upstream of said exhaust filter and adapted to blow air through said exhaust filter.

9. The biosafety cabinet of claim 8, wherein said cabinet further comprises an exhaust conduit extending from said exhaust filter, said exhaust conduit configured to be releasably secured in fluid flow communication with an external ventilation system such that air exiting the exhaust filter is directed to said external ventilation system and exhausted outside the laboratory when said conduit is secured.

10. The biosafety cabinet of claim 1, wherein said one or more exhaust openings comprise a line of holes positioned adjacent one another in series along the work surface extending from the front of said work surface to the back of said work surface.

11. The biosafety cabinet of claim 1, wherein said one or more exhaust openings comprise two lines of holes, each of said lines extending from the front to the back of said work surface and wherein said lines are spaced a distance apart and the area extending between said lines of holes defines an exhaust zone.

12. The biosafety cabinet of claim 11, wherein said one or more exhaust openings further comprise a third line of holes positioned along said front of said work surface within the exhaust zone and rearward of said one or more intake openings.

13. The biosafety cabinet of claim 11, wherein said back wall defines one or more rear openings and wherein said one or more rear openings within said exhaust zone are in fluid flow communication with said exhaust duct and said one or more rear openings outside of said exhaust zone are in fluid flow communication with said recirculation duct.

14. The biosafety cabinet of claim 11, wherein said work surface defines one or more rear openings adjacent said back wall and wherein said one or more rear openings within said exhaust zone are in fluid flow communication with said exhaust duct and said one or more rear openings outside of said exhaust zone are in fluid flow communication with said recirculation duct.

15. The biosafety cabinet of claim 1, wherein said cabinet additionally comprises:

a movable sash configured to increase or decrease the size of the access opening; and a sash grill positioned along a front of the cabinet below said sash and wherein at least a portion of said intake openings are formed within said sash grill.

16. The biosafety cabinet of claim 15 further comprising a plurality of sash alarm switches, wherein each of said alarm switches corresponds to a different maximum operational sash height.

17. The biosafety cabinet of claim 16, wherein said cabinet is programmed to receive input indicating a selection of a maximum operational sash height and wherein said sash alarm switch corresponding to said selected maximum operational sash height is activated and all other of said sash alarm switches are deactivated.

18. The biosafety cabinet of claim 2, wherein said exhaust blower is powered by a programmable variable speed motor and wherein the speed of said motor increases as resistance to airflow increases whereby a constant volume of air is exhausted.

19. The biosafety cabinet of claim 2, further comprising a flow valve having a flap movable between an open position and a closed position, wherein said flap is held in said open position when said cabinet is connected to said external ventilation system and said system is operational.

20. The biosafety cabinet of claim 19, wherein said cabinet additionally comprises an alarm system that is selectively activated when said cabinet is connected to said external ventilation system, and wherein said alarm is triggered by movement of said flap from said open position to said closed position.

21. The biosafety cabinet of claim 20, wherein the speed of said exhaust blower is adjusted when said alarm is triggered.

22. The biosafety cabinet of claim 20, wherein said cabinet is programmed to turn off said supply blower after a selected period of time starting when said alarm is triggered and delay turn off of said exhaust blower until after said supply blower is off.

23. The biosafety cabinet of claim 22, wherein said delay between supply blower turn off and said exhaust blower turn off is approximately 8 to 10 seconds.

24. The biosafety cabinet of claim 23, wherein said selected period of time is between 0 and 5 minutes.

25. The biosafety cabinet of claim 1, wherein at least a portion of said exhaust duct comprises a removable tray positioned below said work surface.

26. The biosafety cabinet of claim 1, wherein said work area comprises at least one exhaust zone and said cabinet is configured such that down flow air moving through the exhaust zone is drawn through said one or more exhaust openings into said exhaust duct.

27. The biosafety cabinet of claim 26, wherein said exhaust zone is defined by said one or more exhaust openings extending along the work surface surrounding the exhaust zone.

28. The biosafety cabinet of claim 26, wherein said work area additionally comprises one or more recirculation zones and said cabinet is configured such that down flow air moving through said recirculation zones is drawn into said recirculation duct.

29. The biosafety cabinet of claim 26, wherein said exhaust zone is positioned within at least a front portion of the work area adjacent the access opening.

30. The biosafety cabinet of claim 29, wherein said exhaust zone is positioned between two recirculation zones extending adjacent left and right sides of the work area respectively and said cabinet is configured such that down flow air moving through said recirculation zones is drawn into said recirculation duct.

* * * * *